US011618644B2

(12) United States Patent
Hiroyasu

(10) Patent No.: US 11,618,644 B2
(45) Date of Patent: Apr. 4, 2023

(54) SHEET-FEEDING DEVICE AND SHEET-FEEDING METHOD

(71) Applicant: ZUIKO CORPORATION, Osaka (JP)

(72) Inventor: Masato Hiroyasu, Osaka (JP)

(73) Assignee: ZUIKO CORPORATION, Osaka (JP)

( * ) Notice: Subject to any disclaimer, the term of this patent is extended or adjusted under 35 U.S.C. 154(b) by 357 days.

(21) Appl. No.: 17/252,384

(22) PCT Filed: Jul. 25, 2019

(86) PCT No.: PCT/JP2019/029141
§ 371 (c)(1),
(2) Date: Dec. 15, 2020

(87) PCT Pub. No.: WO2020/031706
PCT Pub. Date: Feb. 13, 2020

(65) Prior Publication Data

US 2021/0188585 A1 Jun. 24, 2021

(30) Foreign Application Priority Data

Aug. 7, 2018 (JP) ..... JP2018-148518

(51) Int. Cl.
*B65H 19/18* (2006.01)
*B65H 21/02* (2006.01)

(52) U.S. Cl.
CPC ..... *B65H 19/18* (2013.01); *B65H 21/02* (2013.01)

(58) Field of Classification Search
CPC ..... B65H 19/18; B65H 19/1821; B65H 21/02
See application file for complete search history.

(56) References Cited

U.S. PATENT DOCUMENTS 3,510,036 A 5/1970 Lewis, Jr. et al.
4,387,614 A * 6/1983 Evans ..... B65H 26/02 83/76

(Continued)

FOREIGN PATENT DOCUMENTS

CN 103144986 6/2013
DE 1 260 906 2/1968

(Continued)

OTHER PUBLICATIONS

Extended European Search Report dated Feb. 11, 2022 in European Patent Application No. 19847582.4.

(Continued)

*Primary Examiner* — Sang K Kim
(74) *Attorney, Agent, or Firm* — Wenderoth, Lind & Ponack, L.L.P.

(57) ABSTRACT

A first shaft control section controls a first support shaft so that a sheet is unwound from the first roll at a predetermined running speed. A second shaft control section executes an adjustive control of adjusting at least one of a rotation start time and a rotational acceleration of the second support shaft so that, when a first joining target mark on the sheet of the first roll moves to a first reference position, a second joining target mark on an outer peripheral surface of the second roll arrives at a second reference position in a rotational direction thereof, and a peripheral speed of the second roll coincides with the running speed of the sheet of the first roll.

16 Claims, 10 Drawing Sheets

(56) References Cited

U.S. PATENT DOCUMENTS

| | | | | | |
|---|---|---|---|---|---|
| 4,432,481 | A * | 2/1984 | Miller | B65H 23/1886 | 226/28 |
| 5,253,819 | A * | 10/1993 | Butler, Jr. | B65H 19/1868 | 242/554.6 |
| 5,388,387 | A * | 2/1995 | McElvy | B65B 9/207 | 242/421 |
| 2013/0146701 | A1 | 6/2013 | Talvitie | | |
| 2018/0079614 | A1 * | 3/2018 | Pasquale | B65H 19/1826 | |

FOREIGN PATENT DOCUMENTS

| | | |
|---|---|---|
| JP | 58-60640 | 4/1983 |
| JP | 62-201762 | 9/1987 |
| JP | 2006-188348 | 7/2006 |
| JP | 2011-131947 | 7/2011 |
| JP | 5498770 | 5/2014 |
| JP | 2017-178544 | 10/2017 |
| WO | 2017/145522 | 8/2017 |

OTHER PUBLICATIONS

International Search Report dated Sep. 24, 2019 in International (PCT) Application No. PCT/JP2019/029141.
Office Action dated Apr. 26, 2022 in corresponding Chinese Patent Application No. 2019800455385, along with the English language translation.

* cited by examiner

SHEET-FEEDING DEVICE AND SHEET-FEEDING METHOD

TECHNICAL FIELD

The present invention relates to a sheet supply apparatus and a sheet supply method for continuously supplying a sheet from a roll of sheet.

BACKGROUND ART

There have been conventionally known sheet supply apparatus for sequentially unwinding a sheet from a first roll of sheet and a second roll of sheet for sheet supply (for example, see Patent Literature 1). This sort of sheet supply apparatus includes a joining mechanism for joining the sheet of the first roll (supply roll) in a supply state of supplying the sheet to the sheet of the second roll in a standby state of suspending the supply of the sheet.

In the conventional technology disclosed in Patent Literature 1, after a peripheral speed of the second roll is made to coincide with a running speed of the sheet unwound from the first roll, calculated is a positional deviation between an actual position of a registration mark on an outer peripheral surface of the second roll and a presumed sheet joining position corresponding to a registration mark on the sheet of the first roll as set on the outer peripheral surface of the second roll. A joining mechanism joins the respective sheets of the first roll and the second roll to each other in a state where the actual position of the registration mark on the outer peripheral surface of the second roll meets the presumed sheet joining position by regulating the peripheral speed of the second roll based on a calculated value of the positional deviation.

Here, the actual position in a rotational direction of the registration mark on the outer peripheral surface of the second roll at a time when the peripheral speed of the second roll having started to rotate reaches the running speed of the sheet of the first roll is not always constant. Therefore, the positional deviation between the actual position of the registration mark and the presumed sheet joining position on the outer peripheral surface of the second roll is not constant. As a result, it may take a long time to regulate the peripheral speed of the second roll so that the actual position of the registration mark meets the presumed sheet joining position on the outer peripheral surface of the second roll. Accordingly, the conventional technology has a problem that a time required to join the respective sheets of the first roll and the second roll to each other in the state where their registration marks face each other is increased, which leads to a delay in shift of sheet supply from the first roll to the second roll.

CITATION LIST

Patent Literature

Patent Literature 1: Japanese Patent Publication No. 5498770

SUMMARY OF INVENTION

The present invention has been accomplished in view of the aforementioned problem, and an object of the present invention is to provide a sheet supply apparatus and a sheet supply method for achieving a shorter time required to join respective sheets of the first roll and a second roll to each other in a state where their registration marks face each other.

A sheet supply apparatus according to one aspect of the present invention is an apparatus for sequentially unwinding a sheet for sheet supply from a first roll of sheet and a second roll of sheet. The sheet supply apparatus includes: a first support shaft which rotatably supports the first roll at a center position thereof; a second support shaft which rotatably supports the second roll at a center position thereof; a joining mechanism which joins the respective sheets of the first roll and the second roll to each other by a pressing operation of pressing the sheet run from the first roll rotating in association with rotation of the first support shaft to an adhesive provided on an outer peripheral surface of the second roll rotating in association with rotation of the second support shaft; and a controller which controls the rotation of each of the first support shaft and the second support shaft so that the respective sheets of the first roll and the second roll are joined to each other via the adhesive in a state where a predetermined first joining target mark among a plurality of registration marks provided at a constant interval in a sheet conveyance direction on the sheet of the first roll faces a second joining target mark which is a registration mark near the adhesive on the outer peripheral surface of the second roll. The controller includes: an instructive signal output section which outputs a control instructive signal for instructing the joining mechanism to perform the pressing operation; a first shaft control section which controls the rotation of the first support shaft in response to the control instructive signal so that the sheet is unwound from the first roll for the sheet supply at a predetermined running speed; and a second shaft control section which controls the rotation of the second support shaft in response to the control instructive signal. The second shaft control section is configured to execute an adjustive control of adjusting at least one of a rotation start time and a rotational acceleration of the second support shaft so that, when a predetermined length of the sheet of the first roll is unwound therefrom and the first joining target mark moves to a predetermined first reference position after the instructive signal output section outputs the control instructive signal, the second joining target mark on the outer peripheral surface of the second roll arrives at a second reference position corresponding to the first reference position in a rotational direction of the second roll, and a peripheral speed of the second roll coincides with the running speed of the sheet of the first roll.

A sheet supply method according to another aspect of the present invention is a method for sequentially unwinding a sheet for sheet supply from a first roll of sheet and a second roll of sheet by using a sheet supply apparatus including: a first support shaft which rotatably supports the first roll of sheet at a center position thereof; a second support shaft which rotatably supports the second roll of sheet at a center position thereof; and a joining mechanism which joins the respective sheets of the first roll and the second roll to each other by a pressing operation of pressing the sheet run from the first roll to an adhesive provided on an outer peripheral surface of the second roll. The sheet supply method includes: a sheet supply step of unwinding the sheet from the first roll at a predetermined running speed by rotating the first support shaft for the sheet supply; an adjustment step of adjusting at least one of a rotation start time and a rotational acceleration of the second support shaft so that, when a predetermined first joining target mark among a plurality of registration marks provided on the sheet of the first roll at a constant interval in a sheet conveyance direction moves to a predetermined first reference position by unwinding a predetermined length of the sheet from the first roll, a second joining target mark which is a registration mark that locates near the adhesive on the outer peripheral surface of the second roll arrives at a second reference position corresponding to the first reference position in a rotational direction of the second roll, and a peripheral speed of the second roll coincides with the running speed of the sheet of the first roll; and a joining step of causing the joining mechanism to perform the pressing operation so that the respective sheets of the first roll and the second roll are joined to each other via the adhesive in a state where the first joining target mark on the sheet of the first roll faces the second joining target mark on the outer peripheral surface of the second roll.

According to the present invention, it is possible to achieve a shorter time required to join respective sheets of a first roll and a second roll to each other in a state where their registration marks face each other.

The object, features, and advantages of the present invention will be further clarified by the following detailed description and the accompanying drawings.

DESCRIPTION OF EMBODIMENTS

Hereinafter, a sheet supply apparatus and a sheet supply method according to embodiments of the present invention will be described with reference to the accompanying drawings. It should be noted that the following embodiments illustrate some examples of the invention, and do not delimit the protection scope of the present invention.

Figure 1:
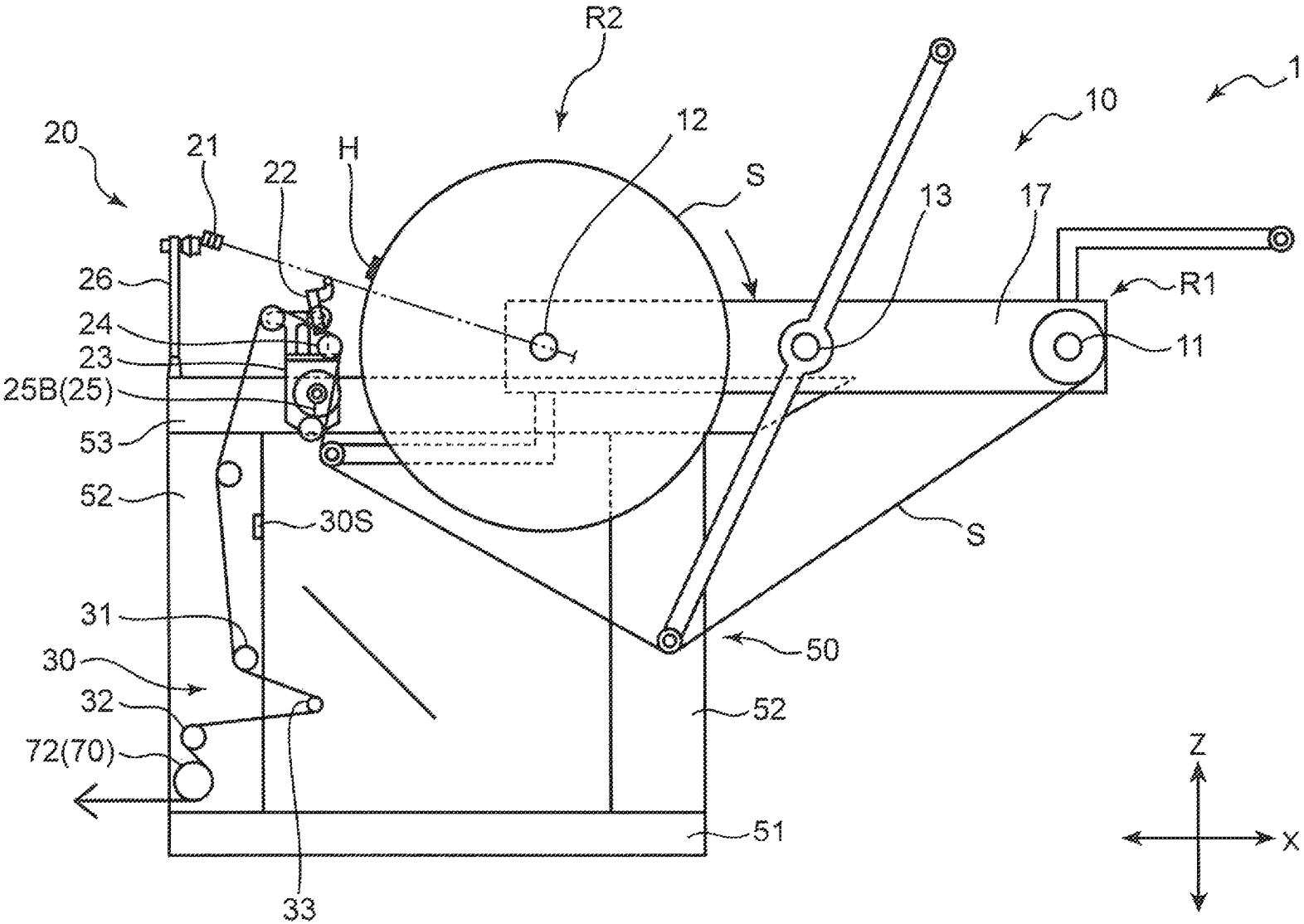
FIG. 1 is a partial cross-sectional front view schematically showing a configuration of a sheet supply apparatus according to an embodiment of the present invention.
Figure 2:
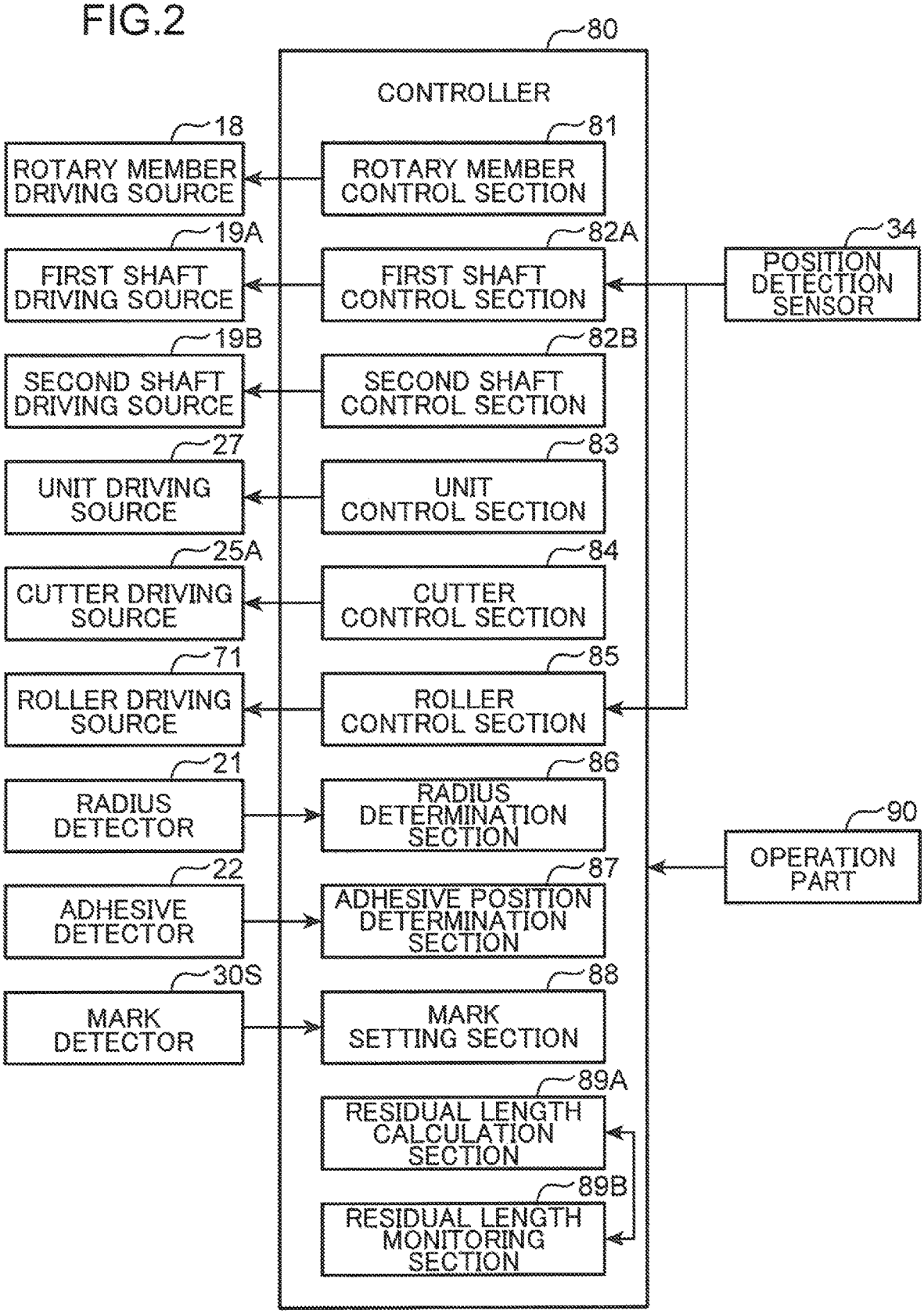
FIG. 2 is a block diagram showing an electrical configuration of a controller which controls operations of the sheet supply apparatus.

FIG. 1 is a partial cross-sectional front view of a sheet supply apparatus 1 according to an embodiment of the present invention. FIG. 2 is a block diagram showing an electrical configuration of a controller 80 which controls operations of the sheet supply apparatus 1. Hereinafter, a lateral direction in FIG. 1 is defined as an "X direction", a vertical direction in FIG. 1 is defined as a "Z direction", and a direction (i.e., a depth direction of the paper sheet in FIG. 1) perpendicularly intersecting the X and Z directions is defined as a "Y direction".

The sheet supply apparatus 1 is an apparatus for sequentially unwinding a sheet S from a first roll R1 of sheet S and a second roll R2 of sheet S. As shown in FIG. 1, the sheet supply apparatus 1 includes a base 50, a support mechanism 10, a joining mechanism 20, a drive part 70, a tension adjusting mechanism 30, and the controller 80. The support mechanism 10 is mounted on the base 50, and supports the first and second rolls R1, R2. The joining mechanism 20 is attached to the base 50 and joins the sheet S run from the first roll R1 to the sheet S of the second roll R2. The drive part 70 supplies the sheet S run from the first roll R1 or the second roll R2 to a downstream location of the sheet supply apparatus 1. The tension adjusting mechanism 30 serves as a control mechanism which executes a feedback control via the controller 80 so that the sheet S is unwound from the first roll R1 or the second roll R2 at a predetermined running speed by detecting a tension of the sheet S at an upstream position of the drive part 70 and regulating a supply speed of the sheet depending on the tension. The controller 80 controls the support mechanism 10 and the joining mechanism 20.

In FIG. 1, the first roll R1 is in a supply state of supplying the sheet S, and the second roll R2 is in a standby state of suspending supply of the sheet S. The sheet supply apparatus 1 can continuously supply the sheet S to a line in the downstream location of the sheet supply apparatus 1 by permitting the joining mechanism 20 to join the sheet S of the second roll R2 (the standby roll) and the sheet S of the first roll R1 (the supply roll) to each other, and to cut the sheet S run from the first roll R1 at an upstream position of a joining portion where the sheets S have been joined to each other. After the joining mechanism 20 performs the joining operation, the controller 80 sets a new roll to be mounted onto a first support shaft 11 as a next standby roll in place of the first roll R1 whose sheet has been cut, and further sets the second roll R2 from which the sheet supply is started as a next supply roll. The shift of the roll setting is repeatedly executed in this manner at every time when the joining mechanism 20 performs the joining operation.

Each of the sheets S of the first roll R1 and the second roll R2 is provided with a plurality of registration marks thereon at a constant interval in a sheet conveyance direction. Each of the registration marks represents a detection mark provided on the sheet S. Here, a part of designs, patterns or the like repetitively given at a predetermined pitch (e.g., a production length) on the sheet S may be used as the registration mark. Further, as shown in FIG. 1, the second roll R2 has an outer peripheral surface provided with an adhesive H (e.g., a double-sided tape) to adhere the sheet S of the second roll R2 and the sheet S of the first roll R1 to each other. The adhesive H on the outer peripheral surface of the second roll R2 is provided near a specific registration mark. The adhesive H may be provided on the registration mark on the outer peripheral surface of the second roll R2 in a rotational direction thereof, or may deviate from the registration mark at a predetermined distance. In the embodiment, the adhesive H is provided on the registration mark on the outer peripheral surface of the second roll R2 in the rotational direction thereof. Structural elements of the sheet supply apparatus 1 will be described below.

The base 50 includes a mount plate 51 placed on a predetermined setting surface, a plurality of pillars 52 extending in the Z direction, and a beam 53 extending in the X direction. As shown in FIG. 1, the pillars 52 stand on the mount plate 51 to face each other in the X direction. The beam 53 has the opposite ends which are fixedly attached to corresponding upper ends of the pillars 52.

The support mechanism 10 is attached to the base 50 rotatably about a rotary shaft 13 extending in the Y direction. Specifically, the support mechanism 10 includes the rotary shaft 13, a rotary member 17 which is rotatable about the rotary shaft 13, and the first support shaft 11 and a second support shaft 12 provided to the rotary member 17 for rotatably supporting the first and second rolls R1, R2 at their respective center positions.

The rotary member 17 extends in a direction orthogonal to the rotary shaft 13. The first support shaft 11 is provided at one end portion of the rotary member 17 that is on one side with respect to the rotary shaft 13, and the second support shaft 12 is provided at the other end portion of the rotary member 17 that is on the other side with respect to the rotary shaft 13. The first and second support shafts 11, 12 are supported on the rotary member 17 by one end thereof and extend in the Y direction (forward of the paper sheet). In this configuration, the first and second rolls R1, R2 can be mounted onto the support mechanism 10 by inserting the first and second support shafts 11, 12 through the centers of the first and second rolls R1, R2 from their respective free ends.

As shown in FIG. 2, the support mechanism 10 further includes a rotary member driving source 18, a first shaft driving source 19A, and a second shaft driving source 19B. The rotary member driving source 18 generates a drive force to rotate the rotary member 17. The first shaft driving source 19A generates a drive force to rotate the first support shaft 11 around its axis. The second shaft driving source 19B generates a drive force to rotate the second support shaft 12 around its axis. Each of the rotary member driving source 18, the first shaft driving source 19A, and the second shaft driving source 19B includes, for example, a motor. The rotary drive force of the motor is transmitted to each of the rotary shaft 13, and the first and second support shafts 11, 12 via a power transmission mechanism including a belt and a pulley. Consequently, the rotary shaft 13, and the first and the second support shafts 11, 12 can rotate around respective axes at a predetermined speed.

Meanwhile, although unillustrated, the rotary member 17 can be held in any posture in an ordinary operation where the sheet S is supplied to the line in the downstream location. For instance, the rotary member 17 may be held in a posture such that the first roll R1 (the supply roll) is at a higher position and closer to the joining mechanism 20 than the second roll R2 (the standby roll) in the Z direction. Further, when joining the respective sheets S of the first and second rolls R1, R2 to each other, the rotary member 17 is caused to rotate about the rotary shaft 13 to move the second or standby roll R2 closer to the joining mechanism 20 as shown in FIG. 1 (to reach a splice position).

The joining mechanism 20 includes a joining unit 23, a unit driving source 27 (FIG. 2), a pressing roller 24, a cutter 25, a radius detector 21, and an adhesive detector 22. The joining unit 23 is movable in the X direction along the beam 53. The unit driving source 27 generates a drive force to move the joining unit 23. The pressing roller 24 presses an intermediate portion of the sheet S run from the first roll R1 onto the outer peripheral surface of the second roll R2. The cutter 25 cuts the sheet S run from the first roll R1. The radius detector 21 detects a distance (a radius, specifically, a radius of the second roll R2) from the center of the second roll R2 to the outer peripheral surface thereof. The adhesive detector 22 detects a circumferential position of the adhesive H provided on the outer peripheral surface of the second roll R2 in the rotational direction of the second roll R2.

Figure 3:
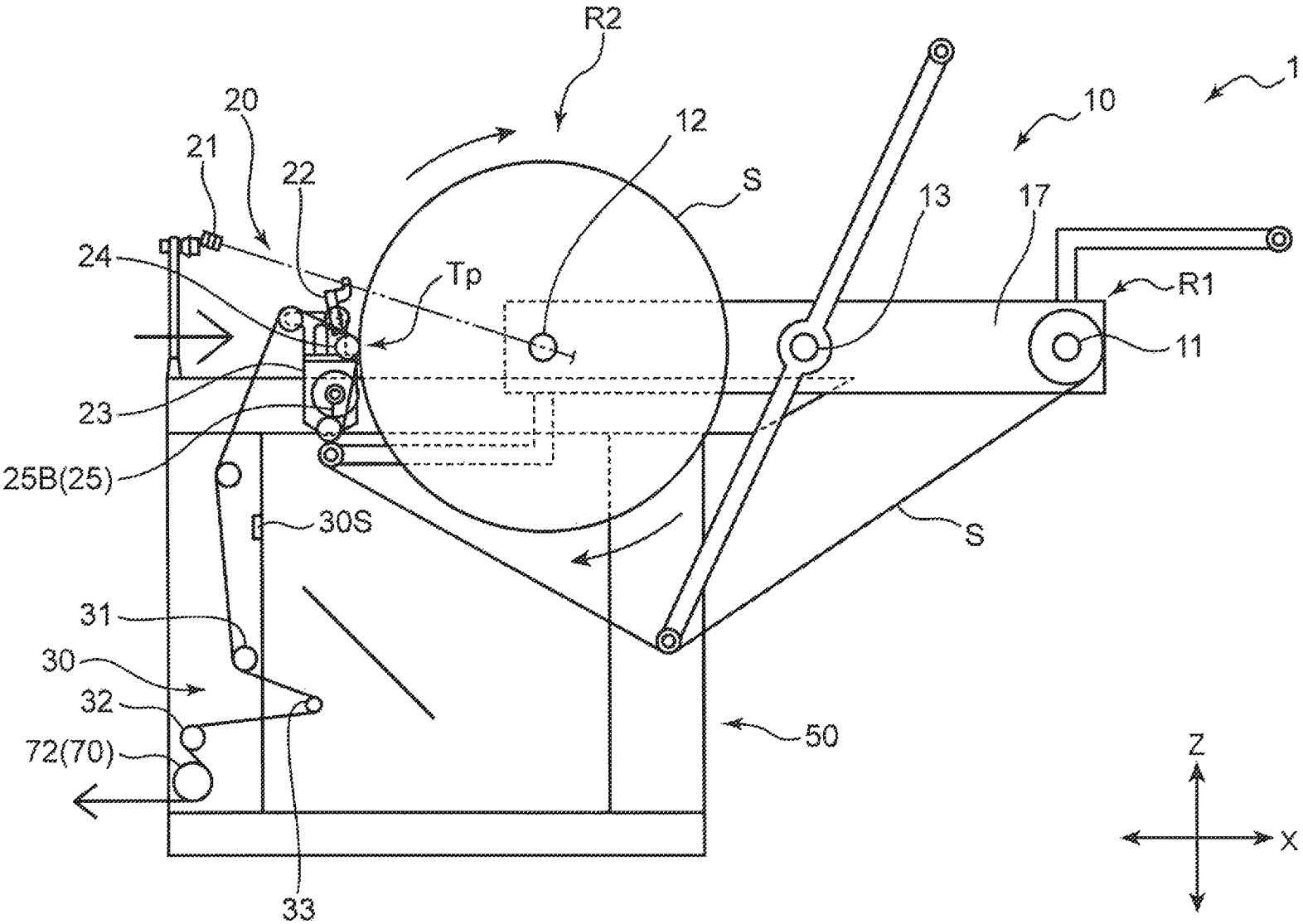
FIG. 3 is a schematic view showing a state where a sheet of a first roll is pressed onto an outer peripheral surface of a second roll in a joining mechanism provided in the sheet supply apparatus.
Figure 4:
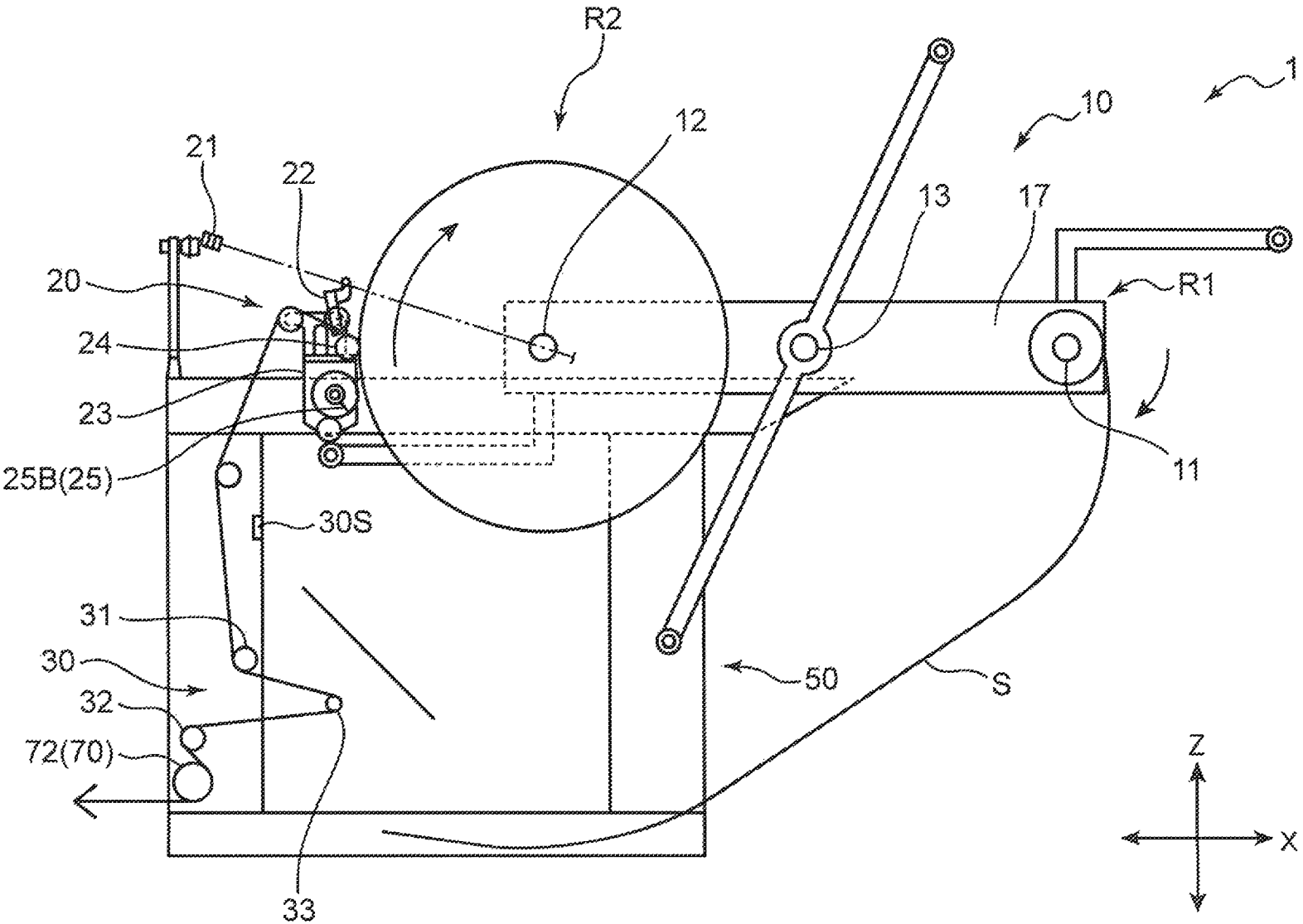
FIG. 4 is a schematic view showing a state where the sheet of the first roll is cut in the joining mechanism.
Figure 5:
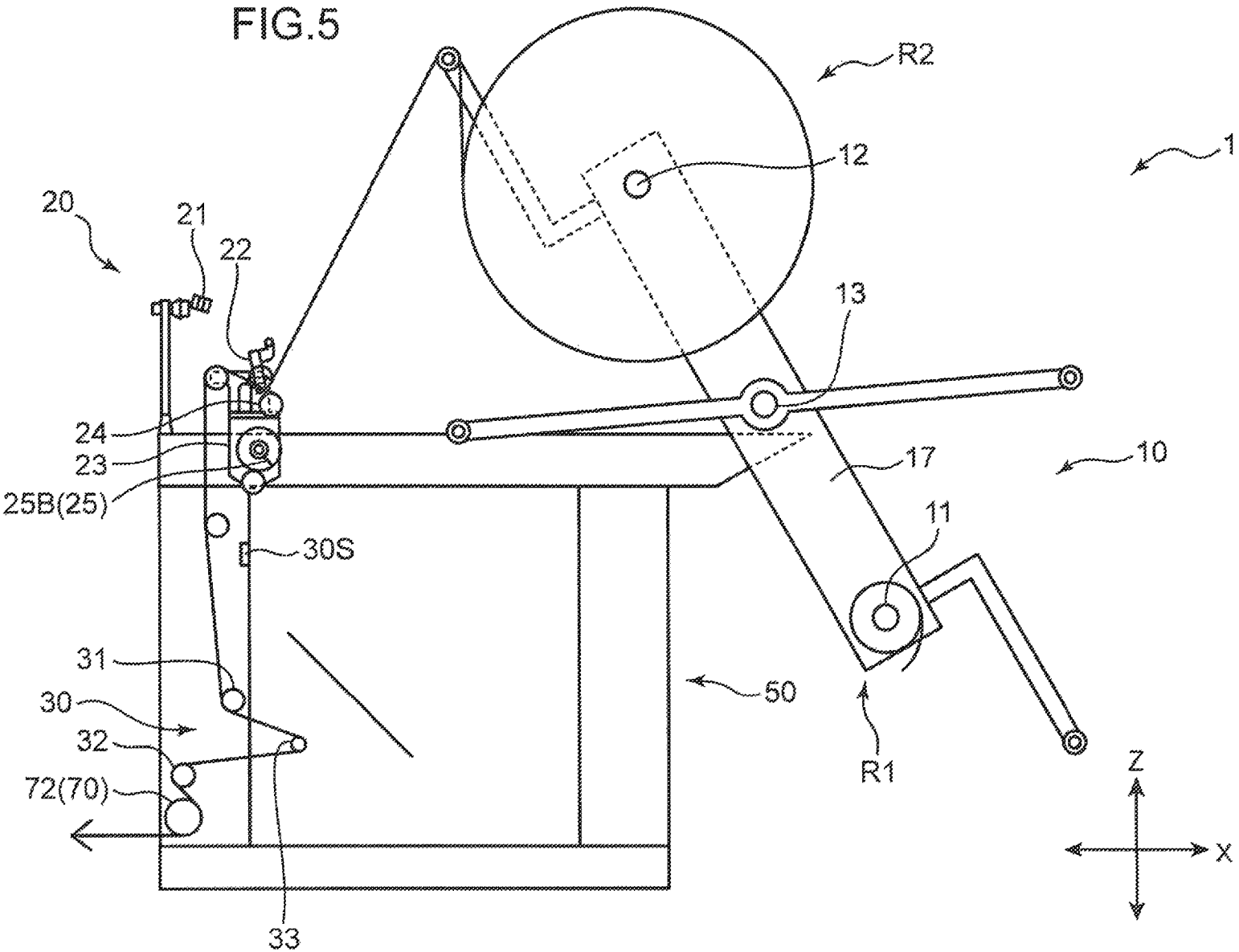
FIG. 5 is a schematic view showing a state where the sheet of the first roll is wound up in the joining mechanism.

The configuration of the joining mechanism 20 will be described with reference to FIGS. 3 to 5 in addition to FIGS. 1 and 2. FIG. 3 is a schematic view showing a state where the sheet S of the first roll R1 is pressed onto the outer peripheral surface of the second roll R2 in the joining mechanism 20. FIG. 4 is a schematic view showing a state where the sheet S of the first roll R1 is cut in the joining mechanism 20. FIG. 5 is a schematic view showing a state where the sheet S of the first roll R1 is wound up in the joining mechanism 20.

The unit driving source 27 includes, for example, a servomotor, and the drive force thereof is transmitted to the joining unit 23 via a power transmission mechanism including a belt and a pulley. Owing to the transmitted drive force, it is possible to move the joining unit 23 forward to be closer to the second roll R2 at the splice position and backward to be away from the second roll R2.

The pressing roller 24 has an axis extending in the Y direction, and is attached to the joining unit 23. Hence, the pressing roller 24 shifts forward and backward together with the joining unit 23 while kept in parallel to the axis of the second roll R2. This configuration achieves a joining operation of joining the sheets S by causing the pressing roller 24 to press the intermediate portion of the sheet S run from the first roll R1 onto the outer peripheral surface of the second roll R2 to thereby adhere the sheets S to each other via the adhesive H. In other words, the joining mechanism 20 performs the joining operation of joining the respective sheets S of the first roll R1 and the second roll R2 to each other by causing the pressing roller 24 to perform the pressing operation of pressing the sheet S run from the first roll R1 rotating in association with the rotation of the first support shaft 11 to the adhesive H provided on the outer peripheral surface of the second roll R2 rotating in association with the rotation of the second support shaft 12 (see FIG. 3).

The cutter 25 has a cutter blade 25B rotatable about an axis extending in the Y direction, and a cutter driving source 25A (FIG. 2) which generates a drive force to rotate the cutter blade 25B. The cutter 25 is also attached to the joining unit 23, and thus shifts forward and backward together with the joining unit 23. The cutter 25 can cut the sheet S run from the first roll R1 at an upstream position of the joining portion where the sheets S have been joined to each other after the joining operation (see FIG. 4). After the cutter 25 cuts the sheet S of the first roll R1 at the finish of the joining operation, the first roll R1 is reversely rotated to wind up the portion of the sheet S that is upstream of the cutting position (see FIG. 5).

The radius detector 21 includes, for example, a laser sensor. As shown in FIG. 1, the radius detector 21 is fixedly held at a higher position than the joining unit 23 via a bracket 26 standing on the beam 53.

The adhesive detector 22 includes, for example, a color sensor (a line sensor or an area sensor). The adhesive detector 22 is further attached to the joining unit 23, and thus shifts forward and backward together with the joining unit 23. In the case where the adhesive H is provided on the registration mark on the outer peripheral surface of the second roll R2 like the embodiment, the adhesive detector 22 detects the position of the adhesive H, and hence can grasp the position of the registration mark on the outer peripheral surface of the second roll R2 based on a result of the detection as well. Conversely, in the case where the adhesive H deviates from the registration mark at a predetermined distance on the outer peripheral surface of the second roll R2, it is possible to grasp the position of the registration mark on the outer peripheral surface of the second roll R2 based on the deviation at the predetermined distance and the result of the detection of the position of the adhesive H. Moreover, in the case where the distance is desirably determined, the adhesive detector 22 detects both the adhesive H and the registration mark locating near the adhesive H on the outer peripheral surface of the second roll R2. Consequently, it is possible to grasp the position of the registration mark with respect to the adhesive H on the outer peripheral surface of the second roll R2.

The drive part 70 is arranged at a most downstream position in a sheet conveyance direction in the sheet supply apparatus 1. The drive part 70 includes a driving roller 72 having an axis extending in the Y direction so as to support the sheet S, and a roller driving source 71 (FIG. 2) which generates a drive force to rotate the driving roller 72 around the axis at a predetermined speed. The roller driving source 71 includes, for example, a motor. A conveyance speed is regulated to supply the sheet S to the line in the downstream location at a predetermined conveyance speed by adjusting the rotational speed of the driving roller 72 via the output from the roller driving source 71. In this case, the rotational speed of the first support shaft 11 is regulated so that the sheet S is unwound from the first roll R1 at a predetermined running speed.

The tension adjusting mechanism 30 is provided between the joining unit 23 and the driving roller 72 in the sheet conveyance direction. The tension adjusting mechanism 30 executes feedback control via the controller 80 so that the sheet S is unwound from the first roll R1 at the predetermined running speed. As shown in FIG. 1, the tension adjusting mechanism 30 has a pair of fixed rollers 31, 32, and a movable roller 33 which is disposed between the pair of fixed rollers 31, 32 and moved depending on a tension of the sheet S. The sheet S run from the first roll R1 can be supported on the fixed rollers 31, 32, and the movable roller 33. When the tension of the sheet S is lower than a predetermined set value, the movable roller 33 is moved to increase a path length of the sheet S. Conversely, when the tension of the sheet is higher than the set value, the movable roller 33 is moved to decrease the path length of the sheet S.

The tension adjusting mechanism 30 further includes a position detection sensor 34 (FIG. 2) for detecting the position of the movable roller 33. A result of the detection obtained by the position detection sensor 34 is sent to the controller 80. The controller 80 regulates the rotational speed of the first support shaft 11 based on the detection result. In other words, positional information of the movable roller 33 is fed back for the rotation control of the first support shaft 11. Owing to the feedback, the tension is changed to place the movable roller 33 at a predetermined setting position by adjusting the supply speed of the sheet S run from the first roll R1 by way of acceleration or deceleration. This consequently makes it possible to regulate the rotational speed of the first support shaft 11 so that the sheet S is unwound from the first roll R1 at the predetermined running speed.

Moreover, as shown in FIG. 1, a mark detector 30S is provided at a position downstream of the joining mechanism 20 and upstream of the tension adjusting mechanism 30 in the sheet conveyance direction. In other words, the mark detector 30S is arranged between the joining mechanism 20 and the tension adjusting mechanism 30 in the sheet conveyance direction. The mark detector 30S detects each of the plurality of registration marks provided on the sheet S unwound from the first roll R1 at the predetermined running speed, and detects a mark interval between the adjacent registration marks in the sheet conveyance direction. The mark detector 30S includes, for example, a color sensor (a line sensor or an area sensor).

A mark setting section 88 to be described later refers to a result of the detection of the registration mark on the sheet S of the first roll R1 from the mark detector 30S. Although described in detail later, the mark setting section 88 sets a first joining target mark at a registration mark locating at an upstream position of the registration mark detected by the mark detector 30S by a predetermined number of mark intervals on the sheet S unwound from the first roll R1 at the predetermined running speed. The mark detector 30S for detecting the registration mark may be arranged at a desired position with respect to the sheet S unwound from the first roll R1 at the predetermined running speed. However, in a case where the tension adjusting mechanism 30 is arranged between the registration mark detected by the mark detector 30S and the first joining target mark set by the mark setting section 88, a path length of the sheet S may not be uniform. It is therefore concerned that the mark setting section 88 would inaccurately set the position of the first joining target mark with respect to a pressing position where the pressing roller 24 in the joining mechanism 20 performs the pressing operation. To avoid the inaccuracy, the mark detector 30S is preferably arranged at the position upstream of the tension adjusting mechanism 30. The mark detector 30S is further preferably attached to the base 50 at a position different from the position of the rotary member 17 which swingably rotates. In the embodiment, the mark detector 30S is arranged at the position downstream of the joining mechanism 20 and upstream of the tension adjusting mechanism 30.

The controller 80 includes a CPU (Central Processing Unit), a RAM (Random Access Memory), a ROM (Read Only Memory) and the like in combination. The controller 80 controls the support mechanism 10 and the joining mechanism 20 when joining the sheet S of the first roll R1 (the supply roll) to the sheet S of the second roll R2 (the standby roll) in the state of supplying the sheet S of the first roll R1. Specifically, the controller 80 controls the support mechanism 10 and the joining mechanism 20 so that the respective sheets S of the first roll R1 and the second roll R2 are jointed to each other via the adhesive H in a state where the predetermined first joining target mark among the plurality of registration marks provided on the sheet S of the first roll R1 at the constant interval in the sheet conveyance direction faces a second joining target mark that is the registration mark near the adhesive H on the outer peripheral surface of the second roll R2.

As shown in FIG. 2, the controller 80 includes a rotary member control section 81, a first shaft control section 82A, a second shaft control section 82B, a unit control section 83, a cutter control section 84, a roller control section 85, a radius determination section 86, an adhesive position determination section 87, the mark setting section 88, a residual length calculation section 89A, and a residual length monitoring section 89B.

The rotary member control section 81 controls rotation and stop of the motor constituting the rotary member driving source 18. Thus, the rotation of the rotary member 17 about the rotary shaft 13 is controlled. The first shaft control section 82A controls rotation and stop of the motor constituting the first shaft driving source 19A. In this way, the rotation of the first support shaft 11 supporting the first roll R1 is controlled so that the sheet S is unwound from the first roll R1 at the predetermined running speed. The second shaft control section 82B controls rotation and stop of the motor constituting the second shaft driving source 19B. In this way, the rotation of the second support shaft 12 supporting the second roll R2 is controlled depending on the conveyance situation of the sheet S of the first roll R1. The unit control section 83 controls drive and stop of the servomotor constituting the unit driving source 27. Consequently, the joining unit 23 is controlled to move closer to or away from the second roll R2 at the splice position.

The cutter control section 84 controls the drive of the cutter driving source 25A. Hence, the rotation of the cutter blade 25B of the cutter 25 is controlled. The roller control section 85 controls rotation and stop of the motor constituting the roller driving source 71. In this way, the rotation of the driving roller 72 is controlled.

The radius determination section 86 determines radiuses of the second roll R2 at a plurality of locations in the rotational direction of the second roll R2 based on the detection result from the radius detector 21 in a state where the second roll R2 (the standby roll) is rotated in association with the rotation of the second support shaft 12 owing to the second shaft driving source 19B, and further determines a mean radius of the second roll R2 based on the determined radiuses. The adhesive position determination section 87 determines a circumferential position of the adhesive H on the outer peripheral surface of the second roll R2 (the standby roll) in the rotational direction thereof based on the detection result from the adhesive detector 22.

The mark setting section 88 sets the first joining target mark at the registration mark locating at the upstream position of the registration mark detected by the mark detector 30S by the predetermined number of mark intervals on the sheet S unwound from the first roll R1 at the predetermined running speed to face the second joining target mark locating near the adhesive H on the outer peripheral surface of the second roll R2. The mark setting section 88 sets the registration mark at the position upstream of the joining mechanism 20 as the first joining target mark on the sheet S unwound from the first roll R1. Specifically, the mark setting section 88 sets the first joining target mark at the registration mark at the position upstream of the pressing position where the pressing roller 24 in the joining mechanism 20 performs the pressing operation on the sheet S run from the first roll R1.

The residual length calculation section 89A calculates a residual length of the sheet S of the first roll R1 in the state where the sheet S is unwound from the first roll R1 (the supply roll) rotating in association with the rotation of the first support shaft 11 at the predetermined running speed. Specifically, the residual length calculation section 89A calculates a radius of the first roll R1 based on the running speed of the sheet S of the first roll R1, and a rotational speed of the first support shaft 11. Furthermore, the residual length calculation section 89A calculates a sheet thickness of the sheet S run from the first roll R1 in accordance with a reduction in the radius of the first roll R1 for each rotation thereof. Moreover, the residual length calculation section 89A calculates the residual length of the sheet S of the first roll R1 based on the radius of the first roll R1 and the sheet thickness of the sheet S.

The residual length monitoring section 89B monitors the residual length of the sheet S of the first roll R1 calculated by the residual length calculation section 89A. The residual length monitoring section 89B serves as an instructive signal outputting section which outputs, to each of the first shaft control section 82A and the second shaft control section 82B, a control instructive signal for instructing the joining mechanism 20 to perform the pressing operation, and instructing rotation control for each of the first support shaft 11 and the second support shaft 12.

The residual length monitoring section 89B may output the control instructive signal at a time when the residual length of the sheet S of the first roll R1 reaches the predetermined residual length, or at a desired time when an operator performs an operation of input to an operation part 90 (FIG. 2). The operations of the residual length monitoring section 89B will be described in detail later.

The controller 80 executes controls described below in the ordinary operation where the sheet is supplied to the downstream location, and in the sheet joining. First, for the sheet supply in the ordinary operation, the controller 80 (the first shaft control section 82A and the roller control section 85) controls the first support shaft 11 and the drive part 70 to supply the sheet S of the first roll R1 (the supply roll) from the drive part 70 to the downstream location at the predetermined conveyance speed set for the line in the downstream location. At this time, the controller 80 controls the first support shaft 11 by using the feedback from the tension adjusting mechanism 30 so that the running speed of the sheet S run from the first roll R1 coincides with the supply speed of the sheet S from the drive part 70.

Further, in the sheet joining, the controller 80 (the first shaft control section 82A, the second shaft control section 82B, and the unit control section 83) controls the first support shaft 11, the second support shaft 12, and the joining mechanism 20 so that the respective sheets S of the first roll R1 and the second roll R2 are joined to each other via the adhesive H in the state where the first joining target mark set on the sheet S of the first roll R1 faces the second joining target mark locating near the adhesive H on the outer peripheral surface of the second roll R2.

Figure 6A:
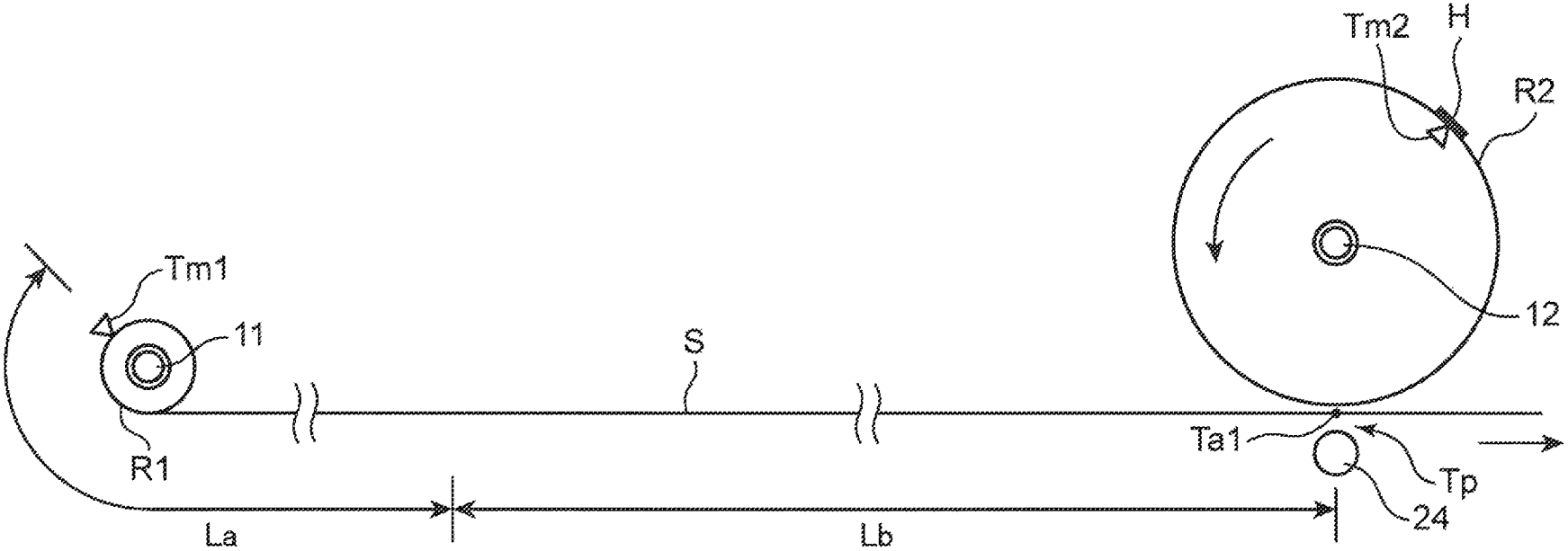
FIG. 6A is a view explaining a processing executed by a controller concerning rotation control for a second support shaft.
Figure 6B:
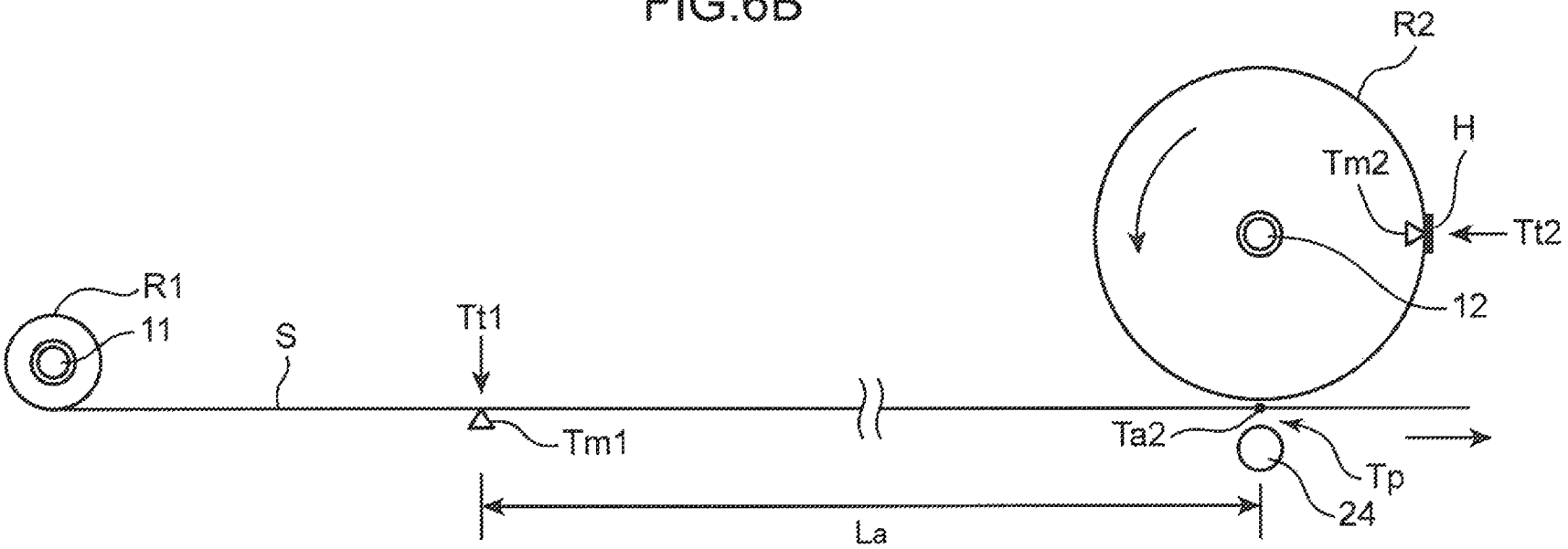
FIG. 6B is a view explaining another processing executed by the controller concerning the rotation control for the second support shaft.
Figure 6C:
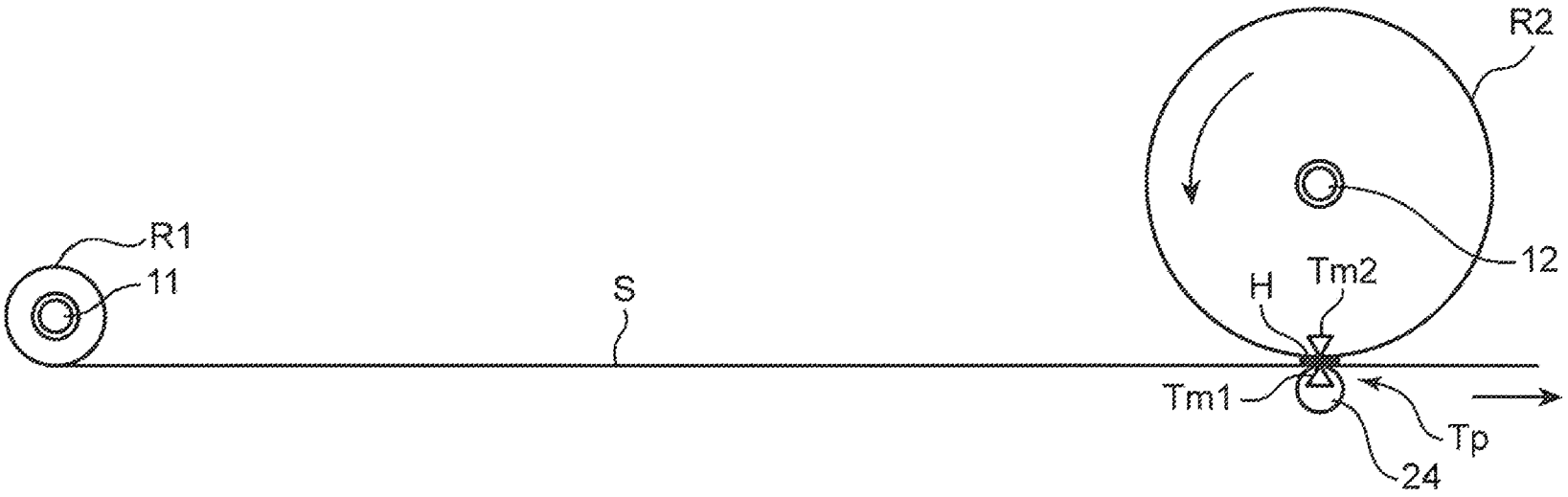
FIG. 6C is a view explaining further another processing executed by the controller concerning the rotation control for the second support shaft.
Figure 7A:
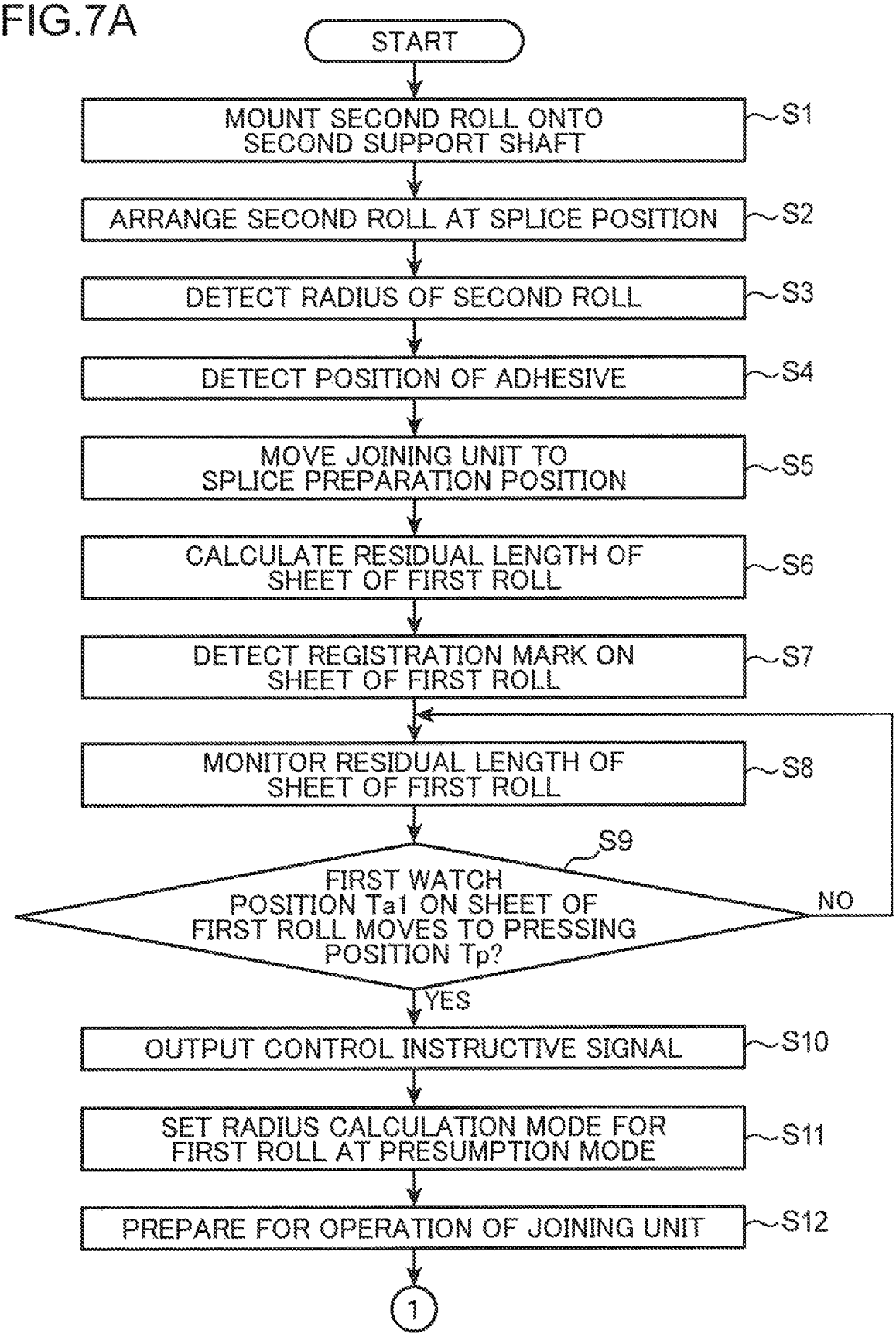
FIG. 7A is a flowchart showing a sequence of the processing executed by the controller.
Figure 7B:
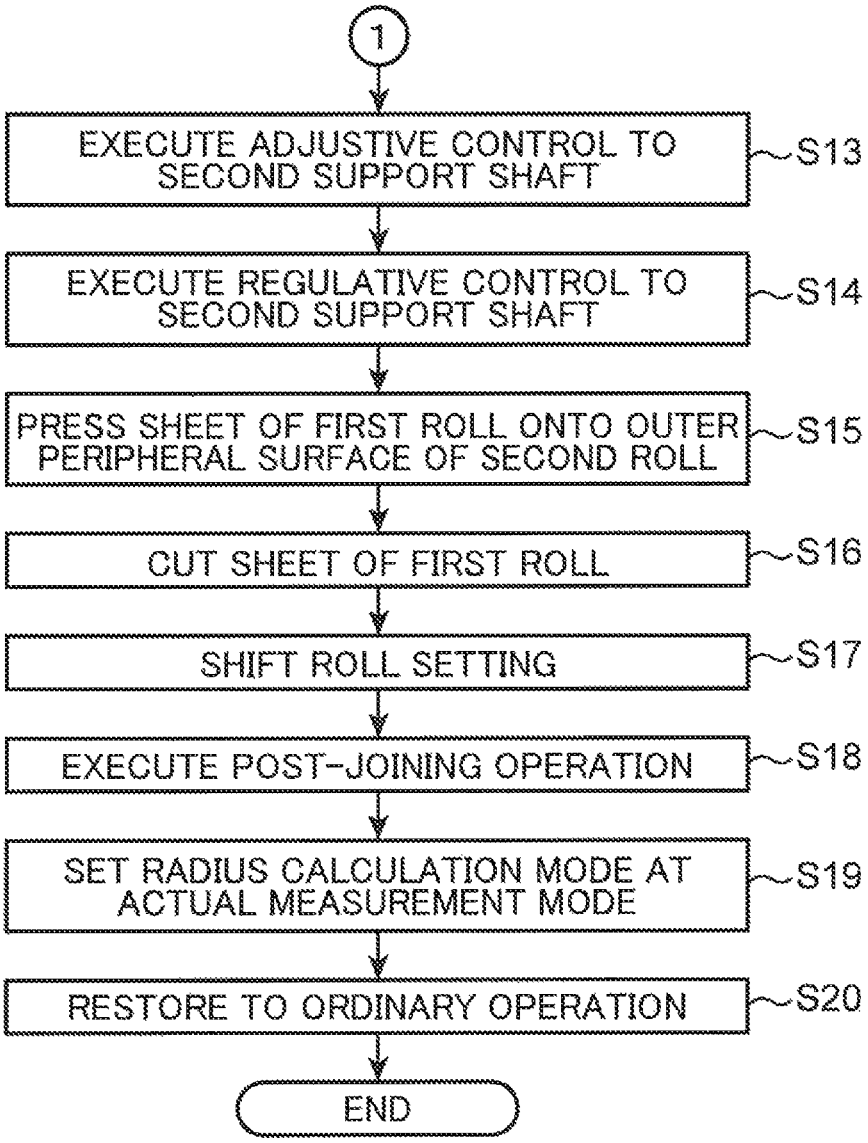
FIG. 7B is a flowchart showing another sequence of the processing executed by the controller.

Hereinafter, a sheet supply method will be described in accordance with a sequence of a processing executed by the controller 80 in the sheet joining with reference to FIGS. 6A, 6B, 6C, 7A, and 7B. Each of FIGS. 6A, 6B, and 6C is a view explaining the processing executed by the controller 80 concerning the rotation control for the second support shaft 12. Each of FIGS. 7A and 7B is a flowchart showing a sequence of the processing executed by the controller 80. Described below is a case where a current sheet is supplied from the first roll R1 supported on the first support shaft 11, and a new second roll R2 is mounted onto the second support shaft 12, i.e., a case where the first roll R1 serves as the supply roll, and the second roll R2 serves as the standby roll. Furthermore, described is another case where a second joining target mark Tm2 that is the registration mark to be arranged near the adhesive H on the outer peripheral surface of the second roll R2 locates at the same position as the adhesive H in the rotational direction of the second roll R2.

A sheet supply step is executed in the ordinary operation where the sheet S is supplied from the first roll R1 to the line in the downstream location prior to the execution of the sheet joining operation. In the sheet supply step, the controller 80 (the first shaft control section 82A, the roller control section 85) controls the first support shaft 11 and the drive part 70 so that the sheet S is unwound from the first roll R1 at the predetermined running speed. Besides, in the sheet supply step, the controller 80 (the first shaft control section 82A) calculates the radius of the first roll R1 based on a conveyance length of the sheet S in the line for each rotation of the first roll R1. A calculation mode for the radius of the first roll R1 is referred to as an "actual measurement mode". The controller 80 (the first shaft control section 82A) regulates the rotational speed of the first support shaft 11 based on the radius of the first roll R1 calculated in the actual measurement mode, and the detection result from the position detection sensor 34 concerning the position of the movable roller 33 in the tension adjusting mechanism 30. In the "actual measurement mode", the controller 80 calculates the radius of the first roll R1 based on the conveyance length of the sheet S for each rotation of the first roll R1, and regulates the rotational speed of the first support shaft 1I based on the calculation result. When an erroneous difference occurs between the regulated running speed of the sheet S from the first roll R1 and the supply speed of the sheet S from the drive part 70, a part of the erroneous difference is absorbed by way of the feedback control of the tension adjusting mechanism 30.

In the sheet supply step, a regulative length La and a peripheral speed adjustive length Lb are set (FIG. 6A) by the operator performing the operation of input to the operation part 90 (FIG. 2). The peripheral speed adjustive length Lb2 represents a conveyance length of the sheet S of the first roll R1 that is presumed to be supplied under an adjustive control executed by the second shaft control section 82B to the second support shaft 12, which will be described in detail later. Although described in detail later, the rotational speed of the second support shaft 12 is regulated so that the peripheral speed of the second roll R2 coincides with the running speed of the sheet S of the first roll R1 under the adjustive control executed by the second shaft control section 82B. A time required to regulate the rotational speed of the second support shaft 12 under the adjustive control by the second shaft control section 82B may be set at, for example, 5 seconds. The peripheral speed adjustive length Lb corresponding to the conveyance length of the sheet S of the first roll R1 to be supplied from the first roll R1 during the adjustive control is set at, for example, 33. 3 mm. Moreover, the regulative length La represents a conveyance length of the sheet S presumed to be supplied from the first roll R1 during the regulative control executed by the second shaft control section 82B to the second support shaft 12, which will be described later. Although described in detail later, the rotational speed of the second support shaft 12 is regulated by way of acceleration or deceleration under the regulative control executed by the second shaft control section 82B. The regulative length La is set at, for example, 10 m to 50 m, specifically, at 25.4 m.

In response to an operation performed by the operator to the operation part 90 for causing the sheet supply apparatus 1 to perform the sheet joining operation, the controller 80 (the rotary member control section 81) controls the rotation of the rotary member 17 so that the second support shaft 12 is moved to a mount position opposite to a splice position where the second support shaft 12 comes closer to the joining mechanism 20 (step S1). In this manner, the operator mounts the second roll R2 onto the second support shaft 12 disposed at the mount position.

After mounting the second roll R2 onto the second support shaft 12, the operator performs an operation of input to indicate finish of the mounting to the operation part 90. In response, the controller 80 (the rotary member control section 81) controls the rotation of the rotary member 17 so that the second support shaft 12 is moved to the splice position where the second support shaft 12 is closer to the joining mechanism 20 (step S2).

After the second support shaft 12 supporting the second roll R2 is moved to the splice position, the controller 80 (the second shaft control section 82B) rotates the second roll R2 by rotating the second support shaft 12. In this state, the radius detector 21 starts to detect the radiuses of the second roll R2 (step S3). After the radius detector 21 detects distances of the second roll R2 (radiuses, specifically, radiuses of the second roll R2) from a roll center to a plurality of circumferential locations on the outer peripheral surface of the second roll R2 for each rotation of the second roll R2, the controller 80 (the second shaft control section 82B) stops the rotation of the second support shaft 12.

After the radiuses to the plurality of circumferential locations of the second roll R2 are detected, the controller 80 (the unit control section 83) causes the joining unit 23 mounted with the adhesive detector 22 to move closer to a position at a predetermined distance from the maximal radius. Thereafter, the controller 80 (the second shaft control section 82B) rotates the second roll R2 by rotating the second support shaft 12. In this state, the adhesive detector 22 detects the position of the adhesive H provided on the second joining target mark Tm2 on the outer peripheral surface of the second roll R2 in the rotational direction of the second roll R2 (step S4). The controller 80 (the adhesive position determination section 87) then determines based on the detection result from the adhesive detector 22 the position of the adhesive H on the outer peripheral surface of the second roll R2 in the circumferential direction of the second roll R2, that is, determines the position in the rotational direction with respect to the second support shaft 12. The controller 80 (the second shaft control section 82B) stops the rotation of the second support shaft 12 so that the adhesive H moves to a predetermined position in the rotational direction of the second roll R2 based on the determined position of the adhesive H.

Subsequently, the controller 80 (the unit control section 83) moves the joining unit 23 to a splice preparation position (step S5). The splice preparation position is set in such a manner that the pressing roller 24 is kept away from coming into contact with the second roll R2 irrespective of difference in the radiuses of the second roll R2 in the rotational direction thereof.

Next, the controller 80 (the residual length calculation section 89A) calculates the residual length of the sheet S of the first roll R1 in a state where the sheet S is unwound from the first roll R1 at the predetermined running speed (step S6). Here, the controller 80 (the residual length calculation section 89A) calculates the residual length of the sheet S of the first roll R1 based on the radius of the first roll R1 and the sheet thickness each changing in accordance with the supply of the sheet S from the first roll R1, as described above. The calculation of the residual length of the sheet S of the first roll R1 is continuously executed for each rotation of the first support shaft 11.

The mark detector 30S detects the registration mark on the sheet S of the first roll R1 in the state where the sheet S is unwound from the first roll R1 at the predetermined running speed (step S7). The detection of the registration mark by the mark detector 30S is continuously executed in the same manner as the calculation of the residual length of the sheet. Moreover, the controller 80 (the mark setting section 88) sets the first joining target mark Tm1 at the registration mark locating at the upstream position of the registration mark detected by the mark detector 30S by the predetermined number of mark intervals based on the detection result from the mark detector 30S to face the second joining target mark Tm2 on which the adhesive H is provided on the outer peripheral surface of the second roll R2. Specifically, the controller 80 (the mark setting section 88)

sets, on the sheet S run from the first roll R1, the first joining target mark Tm1 at the registration mark locating at the upstream position of a pressing position Tp where the pressing roller 24 in the joining mechanism 20 performs the pressing operation by the predetermined length (the regulative length La+the peripheral speed adjustive length Lb) in the sheet conveyance direction (see FIG. 6A).

The controller 80 (the residual length monitoring section 89B) monitors the residual length of the sheet S of the first roll R1 calculated for each rotation of the first support shaft 1I (step S8). The monitoring of the residual length of the sheet S of the first roll R1 is also continuously executed for each rotation of the first support shaft 11 in the same manner as the calculation of the residual length of the sheet.

The controller 80 (the residual length monitoring section 89B) determines whether a first watch position Ta1 locating at a downstream position of the first joining target mark Tm1 by the predetermined length (the regulative length La+the peripheral speed adjustive length Lb) in the sheet conveyance direction on the sheet S of the first roll R1 meets the pressing position Tp (step S9). When determining that the first watch position Ta1 on the sheet S of the first roll R1 meets the pressing position Tp, the controller 80 (the residual length monitoring section 89B) outputs a control instructive signal for instructing the rotation control for the first support shaft 11 and the second support shaft 12 (step S10, see FIG. 6A).

Steps S11, S12, S13 and S14 are executed after the control instructive signal is output in the step S10.

In the step S11, the controller 80 (the first shaft control section 82A) shifts the setting of the calculation mode for the radius of the first roll R1 from the "actual measurement mode" to a "presumption mode", and regulates the rotational speed of the first support shaft 11 based on a presumed radius value calculated in the "presumption mode" so that the running speed of the sheet S from the first roll R1 is constant. The "presumption mode" represents a radius calculation mode in which a radius of the first roll R1 that changes for each rotation of the first roll R1 is calculated and presumed in accordance with its change caused by the supply of the sheet S from the first roll R1, and a presumed radius value based on the calculation and presumption is set as a radius for regulating the rotational speed of the first support shaft 11, the change caused by the supply of the sheet S having been referred to in the residual length calculation step S6 and the residual length monitoring step S8 of calculating the residual length of the sheet S of the first roll R1. Specifically, the controller 80 (the first shaft control section 82A) controls, in the step S11, the rotation of the first support shaft 11 by shifting from the control using: the radius of the first roll R1 (i.e., the radius based on the conveyance length of the sheet S for each rotation of the first roll R1) calculated in the "actual measurement mode"; and the detection result (i.e., the tension of the sheet S of the first roll R1) from the position detection sensor 34 to the control using the presumed radius value of the first roll R1 calculated in the "presumption mode". The controller 80 (the first shaft control section 82A) then regulates the rotational speed of the first support shaft 11 so that the running speed of the sheet S from the first roll R1 is constant based on the presumed radius value calculated in the "presumption mode". The regulation of the rotational speed of the first support shaft 11 based on the presumed radius value of the first roll R1 calculated in the "presumption mode" is executed in a period of time from the step S11 executed after the control instructive signal is output to the step S18 in which the joining mechanism 20 performs the joining operation.

Here, the feedback control of the tension adjusting mechanism 30 is executed for the control of regulating the rotational speed of the first support shaft 11 based on the presumed radius value of the first roll R1 calculated in the "presumption mode" in the same manner as the regulation in the "actual calculation mode". The feedback control of the tension adjusting mechanism 30 achieves a smaller erroneous difference between the running speed of the sheet S from the first roll R1 and the supply speed of the sheet S at the drive part 70.

In the step S12, the controller 80 (the unit control section 83, the cutter control section 84) executes preparation for operating the joining unit 23. Specifically, the controller 80 (the unit control section 83) sets a time for moving the joining unit 23 so that the pressing roller 24 performs the pressing operation. Additionally, the controller 80 (the cutter control section 84) sets a time for controlling the cutter blade 25B of the cutter 25 to rotate at the time when the pressing roller 24 performs the pressing operation.

In the step 13, the controller 80 (the second shaft control section 82B) executes the adjustive control to the second support shaft 12 supporting the second roll R2 (adjustment step). The controller 80 (the second shaft control section 82B) adjusts at least one of a rotation start time and a rotational acceleration of the second support shaft 12 so that, when a predetermined length (the peripheral speed adjustive length Lb) of the sheet S of the first roll R1 is unwound therefrom and the first joining target mark Tm1 moves to a predetermined first reference position Tt1 under the adjustive control after the instructive signal is output, the second joining target mark Tm2 on the outer peripheral surface of the second roll R2 arrives at a second reference position Tt2 corresponding to the first reference position Tt1 in the rotational direction of the second roll R2, and the peripheral speed of the second roll R2 coincides with the running speed of the sheet S of the first roll R1 (see FIG. 6B).

The sheet S of the first roll R1 is supplied by the predetermined length corresponding to the peripheral speed adjustive length Lb during a period of time until the peripheral speed of the second roll R2 reaches the running speed of the sheet S of the first roll R1 after the second support shaft 12 starts to rotate under the adjustive control. That is to say, the sheet S of the first roll R1 is supplied by the peripheral speed adjustive length Lb after the rotation of the second support shaft 12 is started so that the first joining target mark Tm1 moves to the first reference position Tt1. Besides, the peripheral speed of the second roll R2 reaches the running speed of the sheet S of the first roll R1 when the second watch position Ta2 downstream of the first joining target mark Tm1 in the sheet conveyance direction by the regulative length La on the sheet S of the first roll R1 meets the pressing position Tp. At this time, the second joining target mark Tm2 and the adhesive H on the outer peripheral surface of the second roll R2 arrive at the second reference position Tt2 in the rotational direction (see FIG. 6B). The first reference position Tt1 where the first joining target mark Tm1 locates on the sheet S of the first roll R1 after the execution of the adjustive control is upstream of the pressing position Tp in the sheet conveyance direction of the sheet S of the first roll R1 by the predetermined management length (the regulative length La). Additionally, the second reference position Tt2 where the second joining target mark Tm2 and the adhesive H locate on the outer peripheral surface of the second roll R2 after the execution of the adjustive control is upstream of the pressing position Tp in the rotational direction of the second roll R2 by the predetermined length (the regulative length La).

In the step S14, the controller 80 (the second shaft control section 82B) executes the regulative control to the second support shaft 12 supporting the second roll R2 (regulation step) subsequent to the adjustive control. Under the regulative control, the controller 80 (the second shaft control section 82B) regulates the rotational speed of the second support shaft 12 by way of acceleration or deceleration so that a distance between the second joining target mark Tm2 and the pressing position Tp becomes equal to the distance between the first joining target mark Tm1 and the pressing position Tp when the adhesive H at the second reference position Tt2 moves to the pressing position Tp by the predetermined management length (the regulative length La) owing to the rotation of the second roll R2.

In the embodiment, the adhesive H is provided on the second joining target mark Tm2 on the outer peripheral surface of the second roll R2. This means that the second joining target mark Tm2 moves to the pressing position Tp at the same time as the adhesive H moves to the pressing position Tp under the regulative control. Furthermore, the first joining target mark Tm1 having the distance to the pressing position Tp that is equal to the distance between the second joining target mark Tm2 and the pressing position Tp also moves to the pressing position Tp when the adhesive H moves to the pressing position Tp under the regulative control. Specifically, in the case where the adhesive H is provided on the second joining target mark Tm2 on the outer peripheral surface of the second roll R2 like the embodiment, the controller 80 (the second shaft control section 82B) regulates the rotational speed of the second support shaft 12 by way of acceleration or deceleration under the regulative control so that, when the first joining target mark Tm1 at the first reference position Tt1 moves to the pressing position Tp owing to the unwinding of the sheet S of the first roll R1 by the predetermined management length (the regulative length La), the adhesive H on the second joining target mark Tm2 at the second reference position Tt2 moves to the pressing position Tp, and the peripheral speed of the second roll R2 coincides with the running speed of the sheet S of the first roll R1 (see FIG. 6C).

The rotational speed of the second support shaft 12 is maintained under the condition that the second joining target mark Tm2 and the adhesive H move to the pressing position Tp in the rotational direction of the second roll R2 when the first joining target mark Tm1 on the sheet S of the first roll R1 moves to the pressing position Tp in the state where the peripheral speed of the second roll R2 coincides with the running speed of the sheet S of the first roll R1. The rotation of the second support shaft 12 is decelerated when the distance between the pressing position Tp and the second joining target mark Tm2, as well as adhesive H, at the downstream position in the rotational direction of the second roll R2 is equal to or shorter than the arc length of the semicircle of the second roll R2. The rotation of the second support shaft 12 is accelerated when the distance between the pressing position Tp and the second joining target mark Tm2, as well as the adhesive H, at the downstream position in the rotational direction of the second roll R2 is longer than the arc length of the semicircle of the second roll R2. The rotational speed of the second support shaft 12 is restored to the state where the peripheral speed of the second support shaft 12 coincides with the running speed of the sheet S of the first roll R1 and maintained in this state under the condition that the second joining target mark Tm2 and the adhesive H move to the pressing position Tp in the rotational direction of the second roll R2 when the first joining target mark Tm1 on the sheet S of the first roll R1 moves to the pressing position Tp by way of the acceleration or deceleration. The rotational speed regulation by way of the acceleration or deceleration may be executed for a plurality of times until the first joining target mark Tm1 moves to the pressing position Tp.

Under the regulative control, the controller 80 (the second shaft control section 82B) may execute the regulation by changing an acceleration value during the acceleration of the rotation of the second support shaft 12 so that the adhesive H on the second joining target mark Tm2 moves to the pressing position Tp when the first joining target mark Tm1 on the sheet S of the first roll R1 moves to the pressing position Tp. In this case, it is possible to reduce the regulative operation concerning the rotation control for the second support shaft 12 while the predetermined management length (the regulative length La) of the sheet S of the first roll R1 is unwound. In this manner, the first joining target mark Tm1 and the second joining target mark Tm2 can easily face each other in the joining of the respective sheets of the first roll R1 and the second roll R2 to each other via the adhesive H.

As shown in FIG. 6C, the controller 80 (the unit control section 83) moves the joining unit 23 to cause the pressing roller 24 to perform the pressing operation at the same time as the first joining target mark Tm1 on the sheet S of the first roll R1 and the adhesive H provided on the second joining target mark Tm2 on the outer peripheral surface of the second roll R2 in the rotational direction thereof move to the pressing position Tp (joining step S15). Consequently, the respective sheets S of the first roll R1 and the second roll R2 are jointed to each other via the adhesive H in the state where the first joining target mark Tm1 on the sheet S of the first roll R1 faces the second joining target mark Tm2 on which the adhesive H is provided on the outer peripheral surface of the second roll R2. Meanwhile, in the case where the second joining target mark Tm2 deviates from the adhesive H at a predetermined distance on the outer peripheral surface of the second roll R2, the sheet S of the first roll R1 is joined to the adhesive H on the outer peripheral surface of the second roll R2 when a position at the predetermined distance from the first joining target mark Tm1 on the sheet S of the first roll R1 meets the pressing position Tp.

Moreover, the controller 80 (the cutter control section 84) further rotates the cutter blade 25B of the cutter 25 at a time when the pressing roller 24 performs the pressing operation (step S16), thereby cutting the sheet S from the first roll R1. After the sheet S is cut from the first roll R1, supply of the sheet S from the second roll R2 is started. At this time, the controller 80 shifts the roll setting (step S17). Specifically, the controller 80 sets a new roll mounted onto the first support shaft 11 as a next standby roll in place of the first roll R1 whose sheet has been cut, and sets the second roll R2 from which the sheet supply is started as a next supply roll.

Subsequently, the controller 80 (the first shaft control section 82A, the unit control section 83) executes a post-operation after the joining operation (step S18). Specifically, the controller 80 (the unit control section 83) moves the joining unit 23 backward. The controller 80 (the first shaft control section 82A) then winds up a portion of the sheet S that is upstream of the cutting position by reversely rotating the first roll R1.

Thereafter, the controller 80 (the second shaft control section 82B) sets the calculation mode for the radius of the second roll R2 serving as the supply roll at the "actual measurement mode" (step S19). In this step S19, the controller 80 (the second shaft control section 82B) calculates the radius of the second roll R2 based on a conveyance length of the sheet S in the line for each rotation of the second roll R2. The controller 80 (the second shaft control section 82B) regulates the rotational speed of the second support shaft 12 based on the radius of the second roll R2 calculated in the actual measurement mode and the detection result from the position detection sensor 34 concerning the position of the movable roller 33 of the tension adjusting mechanism 30. The sheet joining operation is restored to the ordinary operation (step S20).

As described above, in the sheet joining in the sheet supply apparatus 1 according to the embodiment, the first shaft control section 82A controls the rotation of the first support shaft 11 supporting the first roll or supply roll R1, and the second shaft control section 82B controls the rotation of the second support shaft 12 supporting the second roll or standby roll R2. The first shaft control section 82A controls the rotation of the first support shaft 11 so that the sheet S is unwound from the first roll R1 at the predetermined running speed.

The second shaft control section 82B executes the adjustive control and the regulative control to the second support shaft 12. The second shaft control section 82B adjusts the rotation start time of the second support shaft 12 under the adjustive control in the embodiment so that the second joining target mark Tm2 on the outer peripheral surface of the second roll R2 faces the first joining target mark Tm1 on the sheet S of the first roll R1 when the respective sheets S of the first roll R1 and the second roll R2 are jointed to each other via the adhesive H. In place of this adjustment way, another adjustment way of adjusting the rotational acceleration may be adopted. Alternatively, both the rotation start time and rotational acceleration may be adjusted. The second joining target mark Tm2 on the outer peripheral surface of the second roll R2 arrives at the predetermined second reference position Tt2 corresponding to the first reference position Tt1 where the first joining target mark Tm1 locates on the sheet S of the first roll R1 when the peripheral speed of the second roll R2 reaches the running speed of the sheet S of the first roll R1 under the adjustive control executed to the second support shaft 12. Even an erroneous difference which may occur in the arrival position of the second joining target mark Tm2 in the rotational direction of the second roll R2 can be a tolerance under the adjustive control executed to the second support shaft 12. Hence, slight regulation of the rotational speed of the second support shaft 12 is sufficient, if necessary, to absorb the tolerance. It is accordingly possible to achieve a shorter time required to join the sheets S of the first roll R1 and the second roll R2 to each other via the adhesive H in the state where their respective registration marks face each other.

Next, the second reference position Tt2 where the adhesive H provided on the second joining target mark Tm2 on the outer peripheral surface of the second roll R2 locates when the peripheral speed of the second roll R2 reaches the running speed of the sheet S of the first roll R1 is set so that the distance between the second reference position Tt2 and the pressing position Tp becomes equal to the predetermined management length (the regulative length La) that is equal the distance between the first reference position Tt1 where the first joining target mark Tm1 locates on the sheet S of the first roll R1 and the pressing position Tp. The rotational speed of the second support shaft 12 may be regulated so that the adhesive H at the predetermined second reference position Tt2 on the outer peripheral surface of the second roll R2 moves to the pressing position Tp at the time when the first joining target mark Tm1 moves to the pressing position Tp under the regulative control subsequent to the adjustive control. In this manner, it is possible to regulate the rotational speed of the second support shaft 12 under the regulative control for a reduced time to move the adhesive H provided on the second joining target mark Tm2 on the outer peripheral surface of the second roll R2 in the rotational direction thereof to the pressing position Tp at the same time as the first joining target mark Tm1 on the sheet S of the first roll R1 moves to the pressing position Tp. This contributes to achievement in a shorter time required to join the sheet S of the first roll R1 at the first joining target mark Tm1 thereon to the adhesive H provided on the second joining target mark Tm2 on the outer peripheral surface of the second roll R2 in the rotational direction thereof.

The mark setting section 88 preferably sets the first joining target mark Tm1 at a registration mark among the plurality of marks provided on the sheet S of the first roll R1 that is disposed at the downstream position in the sheet conveyance direction nearest to the target residual length position on the sheet S of the first roll R1 where the residual length of the sheet of the first roll R1 calculated by the residual length calculation section 89A reaches the predetermined target residual length. In other words, the mark setting section 88 sets the first joining target mark Tm1 to be adhered to the adhesive H on the outer peripheral surface of the second roll R2 at the registration mark that is disposed at the downstream position nearest to the target residual length position. In this configuration, the sheet S of the first roll R1 and the sheet S of the second roll R2 can be joined to each other near the target residual length position. Accordingly, the residual length of the sheet S of the first roll R1 can be set at a value proximate to the predetermined target residual length in the joining of the sheets via the adhesive H on the outer peripheral surface of the second roll R2.

Here, execution of the rotation control for the first support shaft 11 based on the radius of the first roll R1 calculated in the "actual measurement mode" with reference to the conveyance length of the sheet S for each rotation of the first roll R1 may cause frequent fluctuation in the running speed of the sheet S for each rotation due to the acceleration or deceleration. Thus, the first joining target mark Tm1 on the sheet S of the first roll R1 does not always move to the first reference position Tt1 at a constant time. In this case, there is a concern that a difference may occur between the time when the first joining target mark Tm1 on the sheet S of the first roll R1 moves to the first reference position Tt1 and the time when the second joining target mark Tm2 arrives at the second reference position Tt2 on the outer peripheral surface of the second roll R2, which results in failure to allow the registration marks on the respective sheets S of the first roll R1 and the second roll R2 to reliably face each other.

To avoid the difference, the first shaft control section 82A regulates in the sheet joining operation the rotational speed of the first support shaft 11 based on the presumed radius value of the first roll R1 that is calculated in the "presumption mode" on a change in accordance with the supply of the sheet S so that the running speed of the sheet S from the first roll R1 is constant during a period of time until the pressing roller 24 in the joining mechanism 20 performs the pressing operation after the residual length monitoring section 89B outputs the control instructive signal (step S11). The regulation contributes to suppression of fluctuation in the time when the first joining target mark Tm1 on the sheet S of the first roll R1 moves to the first reference position Tt1. Accordingly, the registration marks on the respective sheets S of the first roll R1 and the second roll R2 can reliably face each other.

The embodiments of the present invention are described heretofore, but the present invention should not be limited thereto, and various modifications are available.

(1) In each of the embodiments, the second shaft control section 82B executes the adjustive control of adjusting at least one of the rotation start time and the rotational acceleration of the second support shaft 12 after the residual length monitoring section 89B outputs the control instructive signal, and subsequently executes the regulative control of regulating the rotational speed of the second support shaft 12 by way of acceleration or deceleration. However, the configuration should not be limited thereto.

In a sheet supply apparatus 1 according to a modification, a first shaft control section 82A controls rotation of a first support shaft 11 supporting a first roll R1, and a second shaft control section 82B controls rotation of a second support shaft 12 supporting the second roll R2. The first shaft control section 82A controls rotation of the first support shaft 11 so that a sheet S is unwound from the first roll R1 at a predetermined running speed.

After a residual length monitoring section 89B outputs a control instructive signal, the second shaft control section 82B executes an adjustive control to the second support shaft 12 supporting the second roll R2 (adjustment step). The second shaft control section 82B adjusts at least one of a rotation start time and a rotational acceleration of the second support shaft 12 so that, when a predetermined length (a peripheral speed adjustive length Lb) of the sheet S of the first roll R1 is unwound therefrom and a first joining target mark Tm1 moves to a predetermined first reference position, a second joining target mark Tm2 on the outer peripheral surface of the second roll R2 arrives at the second reference position corresponding to a first reference position in a rotational direction of the second roll R2, and a peripheral speed of the second roll R2 coincides with a running speed of the sheet S of the first roll R1.

An adhesive H is provided on the second joining target mark Tm2 on the outer peripheral surface of the second roll R2 in the rotational direction of the second roll R2. However, contrary to the embodiment, the adhesive H on the second joining target mark Tm2 on the outer peripheral surface of the second roll R2 locates at the pressing position Tp where a joining mechanism 20 performs a pressing operation under the adjustive control executed by the second shaft control section 82B. Besides, the first reference position where the first joining target mark Tm1 locates on the sheet S of the first roll R1 after the execution of the adjustive control meets the pressing position Tp in the conveyance direction of the sheet S of the first roll R1. Furthermore, the second reference position where the second joining target mark Tm2 and the adhesive H locate on the outer peripheral surface of the second roll R2 after the execution of the adjustive control meets the pressing position Tp in the rotational direction of the second roll R2.

In other words, in the sheet supply apparatus 1 according to the modification, the second shaft control section 82B executes the adjustive control of adjusting at least one of the rotation start time and the rotational acceleration of the second support shaft 12 so that, when the first joining target mark Tm1 on the sheet S of the first roll R1 moves to the pressing position Tp, the peripheral speed of the second roll R2 reaches the running speed of the sheet S of the first roll R1, and the adhesive H on the second joining target mark Tm2 on the outer peripheral surface of the second roll R2 moves to the pressing position Tp.

Under the adjustive control, the second shaft control section 82B may perform the adjustment by changing an acceleration value during acceleration of the rotation of the second support shaft 12 so that the adhesive H on the second joining target mark Tm2 moves to the pressing position Tp when the first joining target mark Tm1 on the sheet S of the first roll R1 moves to the pressing position Tp. In this case, the first joining target mark Tm1 and the second joining target mark Tm2 face each other, and the adhesive H moves to the pressing position Tp at the finish of the acceleration of the rotation of the second support shaft 12.

Under the adjustive control executed by the second shaft control section 82B to the second support shaft 12, the peripheral speed of the second roll R2 coincides with the running speed of the sheet S of the first roll R1, and the adhesive H provided on the second joining target mark Tm2 on the outer peripheral surface of the second roll R2 in the rotational direction thereof moves to the pressing position Tp at the time when the first joining target mark Tm1 on the sheet S of the first roll R1 moves to the pressing position Tp. This configuration consequently achieves a shorter time required for the joining of joining the sheet S of the first roll R1 at the first joining target mark Tm1 thereon to the adhesive H on the second joining target mark Tm2 on the outer peripheral surface of the second roll R2 in the rotational direction thereof.

(2) Described in the embodiment is the configuration in which the rotary member 17 includes the first support shaft 11 and the second support shaft 12. However, the rotary member 17 may include three or more support shafts for rotatably supporting corresponding rolls at their respective center positions.

(3) Described in the embodiment is the configuration in which the joining unit 23 is moved in the X direction (lateral direction) to thereby cause the pressing roller 24 to press the sheet S of the first roll R1 onto the outer peripheral surface of the second roll R2 in the joining operation performed by the joining mechanism 20. However, the joining unit 23 should not be limited to this configuration. For example, the joining unit 23 may be moved in the Z direction (vertical direction) in the joining operation performed by the joining mechanism 20.

(4) Described in the embodiment is the configuration independently including the radius detector 21 for detecting the radius of the second roll R2 or the standby roll, and the adhesive detector 22 for detecting the position of the adhesive H on the outer peripheral surface of the second roll R2. Alternatively, a single detector may be adopted to detect the radius of the second roll R2 and the position of the adhesive H.

The above-described embodiments mainly include the invention having the following configurations.

A sheet supply apparatus according to one aspect of the present invention is a sheet supply apparatus for sequentially unwinding a sheet from a first roll of sheet and a second roll of sheet for sheet supply. The sheet supply apparatus includes: a first support shaft which rotatably supports the first roll at a center position thereof; a second support shaft which rotatably supports the second roll at a center position thereof; a joining mechanism which joins the respective sheets of the first roll and the second roll to each other by a pressing operation of pressing the sheet run from the first roll rotating in association with rotation of the first support shaft to an adhesive provided on an outer peripheral surface of the second roll rotating in association with rotation of the second support shaft; and a controller which controls the rotation of each of the first support shaft and the second support shaft so that the respective sheets of the first roll and the second roll are joined to each other via the adhesive in a state where a predetermined first joining target mark among a plurality of registration marks provided at a constant interval in a sheet conveyance direction on the sheet of the first roll faces a second joining target mark which is a registration mark near the adhesive on the outer peripheral surface of the second roll. The controller includes: an instructive signal output section which outputs a control instructive signal for instructing the joining mechanism to perform the pressing operation; a first shaft control section which controls the rotation of the first support shaft in response to the control instructive signal so that the sheet is unwound from the first roll for the sheet supply at a predetermined running speed; and a second shaft control section which controls the rotation of the second support shaft in response to the control instructive signal. The second shaft control section is configured to execute an adjustive control of adjusting at least one of a rotation start time and a rotational acceleration of the second support shaft so that, when a predetermined length of the sheet of the first roll is unwound therefrom and the first joining target mark moves to a predetermined first reference position after the instructive signal output section outputs the control instructive signal, the second joining target mark on the outer peripheral surface of the second roll arrives at a second reference position corresponding to the first reference position in a rotational direction of the second roll, and a peripheral speed of the second roll coincides with the running speed of the sheet of the first roll.

According to the sheet supply apparatus, at least one of the rotation start time and the rotational acceleration of the second support shaft is adjusted so that the second joining target mark on the outer peripheral surface of the second roll faces the first joining target mark on the sheet of the first roll when the respective sheets of the first roll and the second roll are joined to each other via the adhesive under the adjustive control executed by the second shaft control section to the second support shaft. The second joining target mark on the outer peripheral surface of the second roll arrives at the predetermined second reference position corresponding to the first reference position where the first joining target mark locates on the sheet of the first roll when the peripheral speed of the second roll reaches the running speed of the sheet of the first roll under the adjustive control executed to the second support shaft. Even an erroneous difference which may occur in the arrival position of the second joining target mark in the rotational direction of the second roll can be a tolerance under the adjustive control executed to the second support shaft. Hence, slight regulation of the rotational speed of the second support shaft is sufficient, if necessary, to absorb the tolerance. This configuration consequently can achieve a shorter time required to join the sheets of the first roll and the second roll to each other via the adhesive in the state where their respective registration marks face each other.

In the sheet supply apparatus, when the second joining target mark arrives at the second reference position under the adjustive control executed by the second shaft control section, the adhesive on the outer peripheral surface of the second roll locates at a predetermined management length upstream from a pressing position where the joining mechanism performs the pressing operation in the rotational direction of the second roll. Further, the second shaft control section executes a regulative control of regulating the rotational speed of the second support shaft by way of acceleration or deceleration after executing the adjustive control so that, when the adhesive moves to the pressing position by the predetermined management length in accordance with rotation of the second roll, a distance between the second joining target mark and the pressing position becomes equal to a distance between the first joining target mark and the pressing position.

In this aspect, when the peripheral speed of the second roll reaches the running speed of the sheet of the first roll, the position of the adhesive on the outer peripheral surface of the second roll is set so that the distance therefrom to the pressing position corresponds to the predetermined management length. The rotational speed of the second support shaft may be regulated so that the distance between the second joining target mark and the pressing position becomes equal to the distance between the first joining target mark and the pressing position when the adhesive moves to the pressing position by the management length owing to the rotation of the second roll under the regulative control subsequent to the adjustive control.

In the sheet supply apparatus, the adhesive is provided on the second joining target mark on the outer peripheral surface of the second roll in the rotational direction of the second roll, the first reference position is upstream of the pressing position in the sheet conveyance direction of the first roll by the predetermined management length, and the second reference position is upstream of the pressing position in the rotational direction of the second roll by the predetermined management length.

In this aspect, the second reference position where the adhesive provided on the second joining target mark on the outer peripheral surface of the second roll locates when the peripheral speed of the second roll reaches the running speed of the sheet of the first roll is set so that the distance between the second reference position and the pressing position becomes equal to the predetermined management length that is equal to the distance between the first reference position where the first joining target mark locates on the sheet of the first roll and the pressing position. The rotational speed of the second support shaft may be regulated so that the adhesive at the predetermined second reference position on the outer peripheral surface of the second roll moves to the pressing position at the time when the first joining target mark moves to the pressing position under the regulative control subsequent to the adjustive control. In this manner, it is possible to regulate the rotational speed of the second support shaft under the regulative control for a reduced time to move the adhesive provided on the second joining target mark on the outer peripheral surface of the second roll in the rotational direction thereof to the pressing position at the same time as the first joining target mark on the sheet of the first roll moves to the pressing position. This configuration contributes to achievement in a shorter time required to join the sheet of the first roll at the first joining target mark thereon to the adhesive provided on the second joining target mark on the outer peripheral surface of the second roll in the rotational direction thereof.

In the sheet supply apparatus, when the second joining target mark arrives at the second reference position under the adjustive control executed by the second shaft control section, the adhesive on the outer peripheral surface of the second roll locates at a pressing position where the joining mechanism performs the pressing operation.

In the sheet supply apparatus, the adhesive is provided on the second joining target mark on the outer peripheral surface of the second roll in the rotational direction of the second roll, the first reference position meets the pressing position in the sheet conveyance direction of the sheet of the first roll, and the second reference position meets the pressing position in the rotational direction of the second roll.

In this aspect, under the adjustive control executed by the second shaft control section to the second support shaft, the peripheral speed of the second roll coincides with the running speed of the sheet of the first roll, and the adhesive provided on the second joining target mark on the outer peripheral surface of the second roll in the rotational direction thereof moves to the pressing position at the time when the first joining target mark on the sheet of the first roll moves to the pressing position. This configuration consequently achieves a shorter time required for the joining of joining the sheet of the first roll at the first joining target mark thereon to the adhesive on the second joining target mark on the outer peripheral surface of the second roll in the rotational direction thereof.

In the sheet supply apparatus, the controller may further include: a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll. The mark setting section is configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

In this aspect, the first joining target mark on the sheet of the first roll is set at the registration mark that is disposed at the downstream position nearest to the target residual length position. In this configuration, the sheet of the first roll and the sheet of the second roll can be joined to each other near the target residual length position. Accordingly, the residual length of the sheet of the first roll can be set at a value proximate to the predetermined target residual length in the joining of the sheets via the adhesive on the outer peripheral surface of the second roll.

In the sheet supply apparatus, the first shaft control section may be configured to control the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

Execution of the rotation control for the first support shaft based on the conveyance length of the sheet for each rotation of the first roll may cause frequent fluctuation in the running speed of the sheet for each rotation due to the acceleration or deceleration. Thus, the first joining target mark on the sheet of the first roll does not always move to the first reference position at a constant time. In this case, there is a concern that a difference may occur between the time when the first joining target mark on the sheet of the first roll moves to the first reference position and the time when the second joining target mark arrives at the second reference position on the outer peripheral surface of the second roll, which results in failure to allow the registration marks on the respective sheets of the first roll and the second roll to reliably face each other.

To avoid the difference, the first shaft control section regulates the rotation of the first support shaft by shifting from a control using a sheet conveyance length for each rotation of the first roll to a control using a presumed radius value presumed and calculated on a change in the radius of the first roll caused by the supply of sheet. The first shaft control section regulates the rotational speed of the first roll shaft based on the presumed radius value that changes in accordance with the sheet supply so that the running speed of the sheet from the first roll is constant. The regulation contributes to suppression of fluctuation in the time when the first joining target mark on the sheet of the first roll moves to the first reference position. Accordingly, the registration marks on the respective sheets of the first roll and the second roll can reliably face each other.

A sheet supply method according to another aspect of the present invention is a sheet supply method for sequentially unwinding a sheet from a first roll of sheet and a second roll of sheet for sheet supply by using a sheet supply apparatus including: a first support shaft which rotatably supports the first roll of sheet at a center position thereof; a second support shaft which rotatably supports the second roll of sheet at a center position thereof; and a joining mechanism which joins the respective sheets of the first roll and the second roll to each other by a pressing operation of pressing the sheet run from the first roll to an adhesive provided on an outer peripheral surface of the second roll. The sheet supply method includes: a sheet supply step of unwinding the sheet from the first roll at a predetermined running speed by rotating the first support shaft for the sheet supply; an adjustment step of adjusting at least one of a rotation start time and a rotational acceleration of the second support shaft so that, when a predetermined first joining target mark among a plurality of registration marks provided on the sheet of the first roll at a constant interval in a sheet conveyance direction moves to a predetermined first reference position by unwinding a predetermined length of the sheet from the first roll, a second joining target mark which is a registration mark that locates near the adhesive on the outer peripheral surface of the second roll arrives at a second reference position corresponding to the first reference position in a rotational direction of the second roll, and a peripheral speed of the second roll coincides with the running speed of the sheet of the first roll; and a joining step of causing the joining mechanism to perform the pressing operation so that the respective sheets of the first roll and the second roll are joined to each other via the adhesive in a state where the first joining target mark on the sheet of the first roll faces the second joining target mark on the outer peripheral surface of the second roll.

In the adjustment step according to the sheet supply method, at least one of the rotation start time and the rotational acceleration of the second support shaft is adjusted so that the second joining target mark on the outer peripheral surface of the second roll faces the first joining target mark on the sheet of the first roll when the respective sheets of the first roll and the second roll are joined to each other via the adhesive. The second joining target mark on the outer peripheral surface of the second roll arrives at the predetermined second reference position corresponding to the first reference position where the first joining target mark locates on the sheet of the first roll when the peripheral speed of the second roll reaches the running speed of the sheet of the first roll under the execution of the adjustment step. Even an erroneous difference which may occur in the arrival position of the second joining target mark in the rotational direction of the second roll can be a tolerance under the execution of the adjustment step. Hence, slight regulation of the rotational speed of the second support shaft is sufficient, if necessary, to absorb the tolerance. It is accordingly possible to achieve a shorter time required to join the sheets of the first roll and the second roll to each other via the adhesive in the state where their respective registration marks face each other.

Conclusively, according to the present invention, it is possible to achieve a shorter time required to join respective sheets of a first roll and a second roll in a state where their respective registration marks face each other.

The invention claimed is:

1. A sheet supply apparatus for sequentially unwinding a sheet from a first roll of sheet and a second roll of sheet for sheet supply, the sheet supply apparatus comprising:

a first support shaft which rotatably supports the first roll at a center position thereof, a second support shaft which rotatably supports the second roll at a center position thereof, a joining mechanism which joins the respective sheets of the first roll and the second roll to each other by a pressing operation of pressing the sheet run from the first roll rotating in association with rotation of the first support shaft to an adhesive provided on an outer peripheral surface of the second roll rotating in association with rotation of the second support shaft; and a controller which controls the rotation of each of the first support shaft and the second support shaft so that the respective sheets of the first roll and the second roll are joined to each other via the adhesive in a state where a predetermined first joining target mark among a plurality of registration marks provided at a constant interval in a sheet conveyance direction on the sheet of the first roll faces a second joining target mark which is a registration mark near the adhesive on the outer peripheral surface of the second roll, wherein the controller includes:

an instructive signal output section which outputs a control instructive signal for instructing the joining mechanism to perform the pressing operation;

a first shaft control section which controls the rotation of the first support shaft in response to the control instructive signal so that the sheet is unwound from the first roll for the sheet supply at a predetermined running speed; and a second shaft control section which controls the rotation of the second support shaft in response to the control instructive signal, the second shaft control section being configured to execute an adjustive control of adjusting at least one of a rotation start time and a rotational acceleration of the second support shaft so that, when a predetermined length of the sheet of the first roll is unwound therefrom and the first joining target mark moves to a predetermined first reference position after the instructive signal output section outputs the control instructive signal, the second joining target mark on the outer peripheral surface of the second roll arrives at a second reference position corresponding to the first reference position in a rotational direction of the second roll, and a peripheral speed of the second roll coincides with the running speed of the sheet of the first roll.

2. A sheet supply apparatus according to claim 1, wherein when the second joining target mark arrives at the second reference position under the adjustive control executed by the second shaft control section, the adhesive on the outer peripheral surface of the second roll locates at a predetermined management length upstream from a pressing position where the joining mechanism performs the pressing operation in the rotational direction of the second roll, and the second shaft control section executes a regulative control of regulating the rotational speed of the second support shaft by way of acceleration or deceleration after executing the adjustive control so that, when the adhesive moves to the pressing position by the predetermined management length in accordance with rotation of the second roll, a distance between the second joining target mark and the pressing position becomes equal to a distance between the first joining target mark and the pressing position.

3. A sheet supply apparatus according to claim 2, wherein the adhesive is provided on the second joining target mark on the outer peripheral surface of the second roll in the rotational direction of the second roll, the first reference position is upstream of the pressing position in the sheet conveyance direction of the first roll by the predetermined management length, and the second reference position is upstream of the pressing position in the rotational direction of the second roll by the predetermined management length.

4. A sheet supply apparatus according to claim 3, wherein the controller further includes:

a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll, the mark setting section being configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

5. A sheet supply apparatus according to claim 4, wherein the first shaft control section controls the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

6. A sheet supply apparatus according to claim 2, wherein the controller further includes:

a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll, the mark setting section being configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

7. A sheet supply apparatus according to claim 6, wherein the first shaft control section controls the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

8. A sheet supply apparatus according to claim 1, wherein when the second joining target mark arrives at the second reference position under the adjustive control executed by the second shaft control section, the adhesive on the outer peripheral surface of the second roll locates at a pressing position where the joining mechanism performs the pressing operation.

9. A sheet supply apparatus according to claim 8, wherein the adhesive is provided on the second joining target mark on the outer peripheral surface of the second roll in the rotational direction of the second roll, the first reference position meets the pressing position in the sheet conveyance direction of the sheet of the first roll, and the second reference position meets the pressing position in the rotational direction of the second roll.

10. A sheet supply apparatus according to claim 9, wherein the controller further includes:

a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll, the mark setting section being configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

11. A sheet supply apparatus according to claim 10, wherein the first shaft control section controls the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

12. A sheet supply apparatus according to claim 8, wherein the controller further includes:

a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll, the mark setting section being configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

13. A sheet supply apparatus according to claim 12, wherein the first shaft control section controls the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

14. A sheet supply apparatus according to claim 1, wherein the controller further includes:

a residual length calculation section which calculates a radius of the first roll that changes in accordance with the sheet supply from the first roll, and calculates a residual length of the sheet of the first roll from a result of the calculation of the radius; and a mark setting section which sets the first joining target mark among the plurality of registration marks provided on the sheet of the first roll, the mark setting section being configured to set the first joining target mark at a registration mark that is disposed at a downstream position in the sheet conveyance direction nearest to a target residual length position on the sheet of the first roll where the residual length of the sheet of the first roll calculated by the residual length calculation section reaches a predetermined target residual length.

15. A sheet supply apparatus according to claim 14, wherein the first shaft control section controls the rotation of the first support shaft by shifting, based on the control instructive signal, from a control using a sheet conveyance length by each rotation of the first roll to a control using the radius of the first roll to which the residual length calculation section refers when calculating the residual length of the sheet of the first roll, and regulating a rotational speed of the first support shaft based on a presumed radius value calculated on a change in the radius of the first roll so that the running speed of the sheet from the first roll is constant.

16. A sheet supply method for sequentially unwinding a sheet from a first roll of sheet and a second roll of sheet for sheet supply by using a sheet supply apparatus including: a first support shaft which rotatably supports the first roll of sheet at a center position thereof; a second support shaft which rotatably supports the second roll of sheet at a center position thereof, and a joining mechanism which joins the respective sheets of the first roll and the second roll to each other by a pressing operation of pressing the sheet run from the first roll to an adhesive provided on an outer peripheral surface of the second roll, the sheet supply method comprising:

a sheet supply step of unwinding the sheet from the first roll at a predetermined running speed by rotating the first support shaft for the sheet supply;

an adjustment step of adjusting at least one of a rotation start time and a rotational acceleration of the second support shaft so that, when a predetermined first joining target mark among a plurality of registration marks provided on the sheet of the first roll at a constant interval in a sheet conveyance direction moves to a predetermined first reference position by unwinding a predetermined length of the sheet from the first roll, a second joining target mark which is a registration mark that locates near the adhesive on the outer peripheral surface of the second roll arrives at a second reference position corresponding to the first reference position in a rotational direction of the second roll, and a peripheral speed of the second roll coincides with the running speed of the sheet of the first roll; and a joining step of causing the joining mechanism to perform the pressing operation so that the respective sheets of the first roll and the second roll are joined to each other via the adhesive in a state where the first joining target mark on the sheet of the first roll faces the second joining target mark on the outer peripheral surface of the second roll.

* * * * *